US008087476B2

(12) United States Patent
Wassell et al.

(10) Patent No.: US 8,087,476 B2
(45) Date of Patent: Jan. 3, 2012

(54) SYSTEM AND METHOD FOR DAMPING VIBRATION IN A DRILL STRING USING A MAGNETORHEOLOGICAL DAMPER

(75) Inventors: Mark Ellsworth Wassell, Houston, TX (US); Daniel E. Burgess, Portland, CT (US); Jason R. Barbely, East Islip, NY (US)

(73) Assignee: APS Technology, Inc., Wallingford, CT (US)

( * ) Notice: Subject to any disclaimer, the term of this patent is extended or adjusted under 35 U.S.C. 154(b) by 301 days.

(21) Appl. No.: 12/398,983

(22) Filed: Mar. 5, 2009

(65) Prior Publication Data

US 2010/0224410 A1 Sep. 9, 2010

(51) Int. Cl.
*E21B 41/00* (2006.01)
*E21B 7/00* (2006.01)
*E21B 34/06* (2006.01)

(52) U.S. Cl. ..... 175/40; 175/57; 166/66.5

(58) Field of Classification Search ..... 166/65.1, 166/66.5, 66.6, 66.7; 175/321, 57, 61, 40; 267/140.14, 140.15, 125, 137
See application file for complete search history.

(56) References Cited

U.S. PATENT DOCUMENTS

| | | | |
|---|---|---|---|
| 3,947,008 | A | 3/1976 | Mullins |
| 4,133,516 | A | 1/1979 | Jurgens |
| 4,427,079 | A | 1/1984 | Walter |
| 4,647,853 | A | 3/1987 | Cobern |
| 4,761,889 | A | 8/1988 | Cobern et al. |
| 4,779,852 | A | 10/1988 | Wassell |

(Continued)

FOREIGN PATENT DOCUMENTS

WO WO 2005/047640 A2 5/2005

(Continued)

OTHER PUBLICATIONS

Chen, S.L., "Field Investigation of the Effects of Stick-Slip, Lateral and Whirl Vibrations on Roller Cone Bit Performance," *SPE 56439*, presented at the 58th SPE ATCE, Houston, Oct. 3-6, 1991.

(Continued)

*Primary Examiner* — Thomas Beach
*Assistant Examiner* — James Sayre
(74) *Attorney, Agent, or Firm* — Woodcock Washburn LLP

(57) ABSTRACT

A system for damping vibration in a drill string can include a magnetorheological fluid valve assembly having a supply of a magnetorheological fluid, a first member, and a second member capable of moving in relation to first member in response to vibration of the drill bit. The first and second members define a first and a second chamber for holding the fluid. Fluid can flow between the first and second chambers in response to the movement of the second member in relation to the first member. The valve assembly can also include a coil for inducing a magnetic field that alters the resistance of the magnetorheological fluid to flow between the first and second chambers, thereby increasing the damping provided by the valve. A remnant magnetic field is induced in one or more components of the magnetorheological fluid valve during operation that can be used to provide the magnetic field for operating the valve so as to eliminate the need to energize the coils during operation except temporarily when changing the amount of damping required, thereby eliminating the need for a turbine alternator power the magnetorheological fluid valve. A demagnetization cycle can be used to reduce the remnant magnetic field when necessary.

35 Claims, 17 Drawing Sheets

U.S. PATENT DOCUMENTS

| | | | | |
|---|---|---|---|---|
| 4,813,274 | A | 3/1989 | DiPersio et al. | |
| 4,894,923 | A | 1/1990 | Cobern et al. | |
| 4,994,122 | A | 2/1991 | DeBold et al. | |
| 5,034,929 | A | 7/1991 | Cobern et al. | |
| 5,133,419 | A | 7/1992 | Barrington | |
| 5,251,708 | A | 10/1993 | Perry et al. | |
| 5,382,373 | A | 1/1995 | Carlson et al. | |
| 5,816,344 | A | 10/1998 | Turner | |
| 5,833,541 | A | 11/1998 | Turner et al. | |
| 5,927,409 | A | 7/1999 | Turner | |
| 5,931,000 | A | 8/1999 | Turner et al. | |
| 6,102,681 | A | 8/2000 | Turner | |
| 6,105,690 | A | 8/2000 | Biglin, Jr. et al. | |
| 6,123,312 | A | 9/2000 | Dai | |
| 6,123,561 | A | 9/2000 | Turner et al. | |
| 6,134,892 | A | 10/2000 | Turner et al. | |
| 6,257,356 | B1 | 7/2001 | Wassell | |
| 6,378,558 | B1 | 4/2002 | Pohl et al. | |
| 6,568,470 | B2 | 5/2003 | Goodson, Jr. et al. | |
| 6,958,704 | B2 | 10/2005 | Vinegar et al. | |
| 7,021,406 | B2 | 4/2006 | Zitha | |
| 7,032,670 | B2 | 4/2006 | Zitha | |
| 7,036,612 | B1 * | 5/2006 | Raymond et al. | 175/321 |
| 7,219,752 | B2 | 5/2007 | Wassell et al. | |
| 2005/0056463 | A1 | 3/2005 | Aronstram et al. | |
| 2006/0226942 | A1 * | 10/2006 | Dimig et al. | 335/220 |
| 2008/0315471 | A1 | 12/2008 | Wassell et al. | |

FOREIGN PATENT DOCUMENTS

| | | | |
|---|---|---|---|
| WO | 2010101902 | A1 | 9/2010 |

OTHER PUBLICATIONS

Dykstra, M.W., "Experimental Evaluations of Drill Bit and Drill String Dynamics," *SPE 28323*, presented at the 61st SPE ATCE, New Orleans, Sep. 25-28, 1994.

Spencer Jr., B.F., "Phenomenological Model of a Magnetorheological Damper," *Journal of Engineering Mechanics*, ASCE, 123 230-238, 1997.

Turner, W.E., "New Isolator for Controlling BHA Vibrations," *Energy Week Conference*, Houston, Jan. 27, 1997.

Warren, T.M., "Shock Sub Performance Tests," *IADC/SPE 39323*, presented at the 1998 IADC/SPE Drilling Conference, Dallas, Mar. 3-6, 1998.

Harvey, P., "The Design of Steerable Systems to Minimize the Adverse Effects of Motor Imbalance and Drillstring Forces," *SPE 22565*, presented at the 66th SPE ATCE, Dallas, Oct. 6-9, 1991.

"Magnetic Ride Control," *GM Tech Links*, 4:1, pp. 1-2, Jan. 2002.

Tavares, S.S.M. et al., "Magnetic properties of an AISI 420 martensitic stainless steel," Journal of Alloys and Compounds, Nov. 16, 2000, 307-314.

DeAntonio, D.A. , "Soft Magnetic Ferritic Stainless Steels," Advanced Materials & Processes, Oct. 2003, 29-32.

Notification of Transmittal of the International Search Report and the Written Opinion of the International Searching Authority mailed Apr. 27, 2010.

Written Opinion of the International Searching Authority mailed Apr. 27, 2010.

Written Opinion of the International Preliminary Examining Authority mailed Apr. 4, 2011.

Response to Written Opinion submitted Jul. 27, 2010 PCTUS2010025897 APS Technology.

* cited by examiner

SYSTEM AND METHOD FOR DAMPING VIBRATION IN A DRILL STRING USING A MAGNETORHEOLOGICAL DAMPER

Pursuant to 35 U.S.C. §202(c), it is acknowledged that the U.S. government may have certain rights to the invention described herein, which was made in part with funds from the Deep Trek program of the U.S. Department of Energy National Energy Technology Laboratory, Grant Number DE-FC26-02NT41664.

The present invention relates to underground drilling, and more specifically to a system and a method for damping vibration that occurs in a drill string during drilling operations using a MR fluid.

BACKGROUND OF THE INVENTION

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore.

The drill bit is rotated so that the drill bit advances into the earth, thereby forming the bore. In rotary drilling, the drill bit is rotated by rotating the drill string at the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. In the case of motor drilling, the flowing mud also powers a drilling motor which turns the bit, whether or not the drill string is rotating. The drilling mud then flows to the surface through an annular passage formed between the drill string and the surface of the bore.

The drilling environment, and especially hard rock drilling, can induce substantial vibration and shock into the drill string. Vibration also can be introduced by factors such as rotation of the drill bit, the motors used to rotate the drill string, pumping drilling mud, imbalance in the drill string, etc. Such vibration can result in premature failure of the various components of the drill string. Substantial vibration also can reduce the rate of penetration of the drill bit into the drilling surface, and in extreme cases can cause a loss of contact between the drill bit and the drilling surface.

Operators usually attempt to control drill string vibration by varying one or both of the following: the rotational speed of the drill bit, and the down-hole force applied to the drill bit (commonly referred to as "weight-on-bit"). These actions are frequently in reducing the vibrations. Reducing the weight-on-bit or the rotary speed of the drill bit also usually reduces drilling efficiency. In particular, drill bits typically are designed for a predetermined range of rotary speed and weight-on-bit. Operating the drill bit away from its design point can reduce the performance and the service life of the drill bit.

So-called "shock subs" are sometimes used to dampen drill string vibrations. Shock subs, however, typically are optimized for one particular set of drilling conditions. Operating the shock sub outside of these conditions can render the shock sub ineffective, and in some cases can actually increase drill string vibrations. Moreover, shock subs and isolators usually isolate the portions of the drill string up-hole of the shock sub or isolator from vibration, but can increase vibration in the down-hole portion of the drill string, including the drill bit.

One approach that has been proposed is the use of a damper containing a magnetorheological (hereinafter "MR") fluid valve. The viscosity of MR fluid can be varied in a down-hole environment by energizing coils in the valve that create a magnetic field to which the MR fluid is subjected. Varying the viscosity of the MR fluid allows the damping characteristics to be optimized for the conditions encountered by the drill bit. Such an approach is disclosed in U.S. Pat. No. 7,219,752, entitled System And Method For Damping Vibration In A Drill String, issued May 22, 2007, hereby incorporated by reference in its entirety.

The aforementioned U.S. Pat. No. 7,219,752 discloses an MR valve using a mandrel to hold the coils that is made of 410 martensitic stainless steel. Prior art embodiments of similar MR valves have used coil holders made of 12L14 low carbon steel (which has a saturation magnetization of about 14,000 Gauss, a remnant magnetization of 9,000 to 10,000 Gauss, and a coercivity of about 2 to 8 Oersteds) and 410/420 martensitic stainless steel. The shafts in such embodiments have been made of 410 stainless steel, which can have a relative magnetic permeability of 750 Gauss and a coercivity of 6 to 36 Oe. Unfortunately, the inventors have found that the minimum level of damping achievable using such MR valves is compromised by the fact that energizing the coil can result in a low level of permanent magnetization of the valve components. Although this residual, or remnant, magnetization is considerably below that normally used to provide effective damping, it reduces the range of the MR fluid viscosity at the lower end and, therefore, the minimum damping that can be obtained. In prior art MR valves, the problem of remnant magnetization has been addressed by demagnetizing components of the valve that had become permanently magnetized by supplying to the coils current of alternating polarity and decreasing amplitude in a stepwise fashion.

A problem experienced by prior art MR valves is that using a coil to maintain the magnetic field requires a considerable amount of electrical energy. Consequently, turbine alternators, which are expensive and costly to maintain, are typically required to power the coils. An ongoing need, therefore, exists for a MR fluid damping system that can dampen drill-string vibrations, and particularly vibration of the drill bit, throughout a range of operating conditions, including high and low levels of damping, that does not require large amounts of electrical energy.

SUMMARY OF THE INVENTION

In one embodiment, the invention is applied to a damping system for damping vibration in a down hole portion of a drill string in which the damping system comprises an MR valve containing an MR fluid subjected to a magnetic field created by at least one coil. In this embodiment, the invention includes a method of operating the MR valve comprising the steps of: (a) energizing the coil of the MR valve for a first period of time so as to create a first magnetic field that alters the viscosity of the MR fluid, the first magnetic field being sufficient to induce a first remnant magnetization in at least one component of the MR valve, the first remnant magnetization being at least about 12,000 Gauss; (b) substantially de-energizing the coil for a second period of time so as to operate the MR valve using the first remnant magnetization in the at least one component of said MR valve to create a second magnetic field that alters the viscosity of said MR fluid; (c) subjecting the at least one component of the MR valve to a demagnetization cycle over a third period of time so as to reduce the first remnant magnetization of the at least one component of said MR valve to a second remnant magnetization; and (d) operating said MR valve for a third period of time after the demagnetization cycle in step (c). Preferably, the magnetic field associated with the first remnant magnetization is sufficient to magnetically saturate said MR fluid. The value of the remnant magnetization can be measured using a sensor and the coil re-energized when the value drops below a specified minimum.

In another embodiment, a valve assembly for damping vibration of a drill bit is provided, comprising (a) a first member capable of being mechanically coupled to the drill bit so that the first member is subjected to vibration from the drill bit; (b) a supply of magnetorheological fluid; (c) a second member mechanically coupled to the first member so that the second member can move relative to the first member, the first and second members defining a first chamber and a second chamber for holding the magnetorheological fluid, a passage placing the first and second chambers in fluid communication; (d) at least one coil proximate to the passage so that the magnetorheological fluid can be subjected to a magnetic field generated by the at least one coil when the coil is energized; (e) at least a portion of one of said first and second members being capable of having induced therein a remnant magnetic field in response to said magnetic field generated by said at least one coil that is sufficient to operate said MR valve when said coil is de-energized, said portion of said first and second members in which said remnant magnetic field is induced being made from a material have a maximum remnant magnetization of at least about 12,000 Gauss. Preferably, the valve assembly includes means for demagnetizing the portion of said one of the first and second members so as to reduce the induced remnant magnetic field. The valve assembly may include a sensor for measuring the value of the remnant magnetization and means for re-energizing the coil when the value drops below a specified minimum.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show embodiments that are presently preferred. The invention is not limited, however, to the specific instrumentalities disclosed in the drawings. In the drawings the Z arrow indicates the downhole direction or the bore hole, which may or may not be vertical, i.e., perpendicular to the Earth's surface.

FIG. 8(*b*) is a graph of the strength B of the magnetic field to which the MR fluid is subjected versus time, T, that results from energizing the coils according to FIG. 8(*a*).

DESCRIPTION OF PREFERRED EMBODIMENTS

Figure 1:
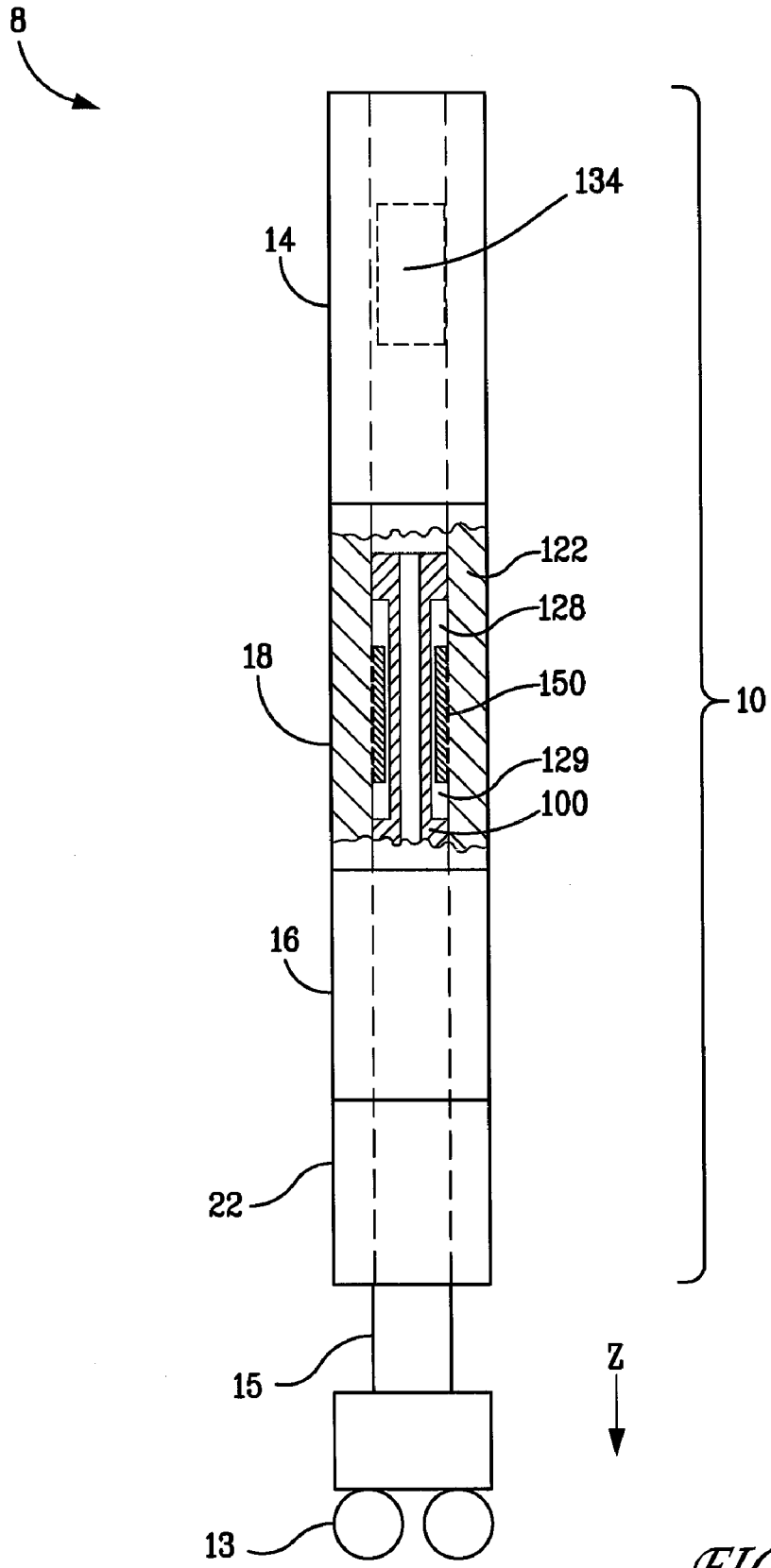
FIG. 1 is a longitudinal view of an embodiment of a vibration damping system installed as part of a drill string.
Figure 2:
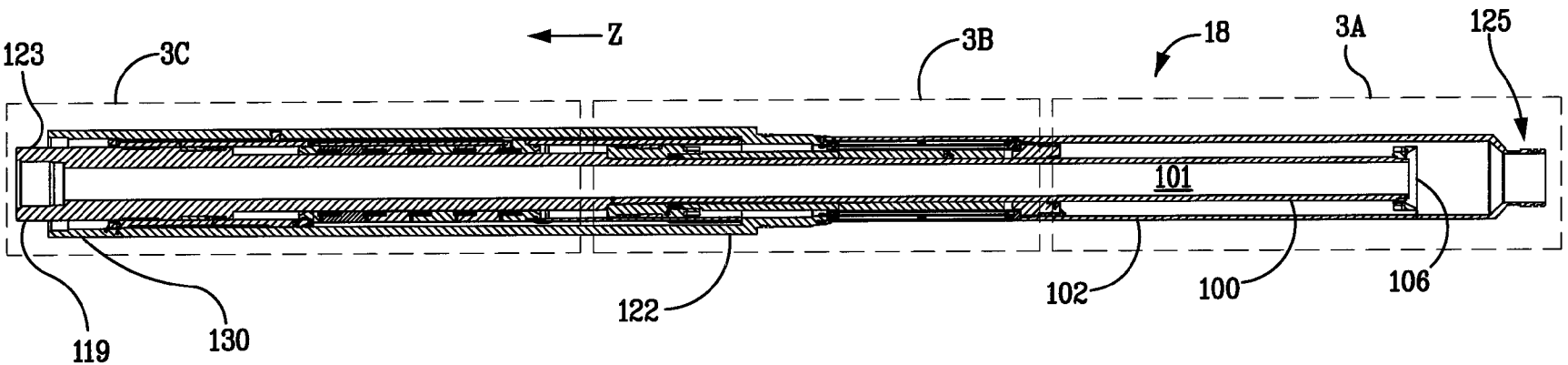
FIG. 2 is a longitudinal cross-sectional view of a valve assembly of the vibration damping system shown in FIG. 1.

The figures depict a preferred embodiment of a vibration damping system 10. As shown in FIG. 1, the vibration damping system 10 can be incorporated into a downhole portion of a drill string 8 to dampen vibration of a drill bit 13 located at a down-hole end of the drill string.

The downhole portion of the drill string 8 includes a power module 14. The vibration damping system 10 comprises a torsional bearing assembly 22 and a spring assembly 16, each of which is discussed more fully in the aforementioned U.S. Pat. No. 7,219,752. In addition, located between the spring assembly 16 and the power module 14 is a magnetorheological ("MR") valve assembly 18. The MR valve assembly 18 and the spring assembly 16 can produce axial forces that dampen vibration of the drill bit 13. The magnitude of the damping force can be varied by the MR valve assembly 18 in response to the magnitude and frequency of the drill bit vibration after the drill bit has temporarily ceased operation, for example during the incorporation of an additional section of drill pipe. In another embodiment, the magnitude of the damping force can be varied by the MR valve assembly 18 in response to the magnitude and frequency of the drill bit vibration on an automatic and substantially instantaneous basis while the drill bit is in operation.

The vibration damping assembly 10 is mechanically coupled to the drill bit 13 by a mandrel 15 that runs through the torsional bearing assembly 22 and spring assembly 16. Power module 14 provides power to the MR valve assembly 18 and may also provide power to other components of the drill string, such as an MWD system. In one embodiment, the power module 14 is a turbine alternator as discussed more fully in the aforementioned U.S. Pat. No. 7,219,752. In another embodiment, the power module 14 contains a battery pack. The controller 134 for the MR valve assembly may also be housed in the power module 14.

Preferably, the MR valve assembly 18 is located immediately down-hole of the power module 14 and uphole of the spring assembly 16, as shown in FIG. 1. Alternatively, the torsional bearing assembly 22 and spring assembly 16 could be located up-hole, between the MR valve assembly 18 and power module 14.

The MR valve assembly 18 is shown in FIGS. 2 and 3A, 3B and 3C. The MR valve assembly 18 has a downhole end 123 and an uphole end 125 and comprises a coil mandrel 100 positioned within an MR valve housing 122. A central passage 101 formed through the coil mandrel 100 allows drilling mud to flow through MR valve assembly 18. A mud flow diverter 106 is attached to the end of the coil mandrel 100.

At the downhole end 123 of the MR valve assembly 18, the coil mandrel 100 is secured by a coupling 119 to the mandrel 15 that extends through the torsional bearing assembly 22 and spring assembly 16 so that the coil mandrel 100 rotates, and translates axially, with the drill bit 13.

An uphole housing 102 encloses the uphole end of the coil mandrel 100. A coupling 104 on the uphole end of the uphole housing 102 is connected to the outer casing of the power module 14 so that the drilling torque from the surface is transferred through power module 14 to the uphole housing 102. The uphole housing 102 transmits the drilling torque to the outer casing of the spring assembly 16 and torsional bearing 22 via the MR valve casing 122, which is connected at its up hole end to the downhole end of the up hole housing 102, and at its downhole end 130 to the other casing of the spring assembly 16. The uphole housing 102 therefore rotates, and translates axially, with the outer casing of the torsional bearing 22 and spring assembly 16.

Figure 3B:
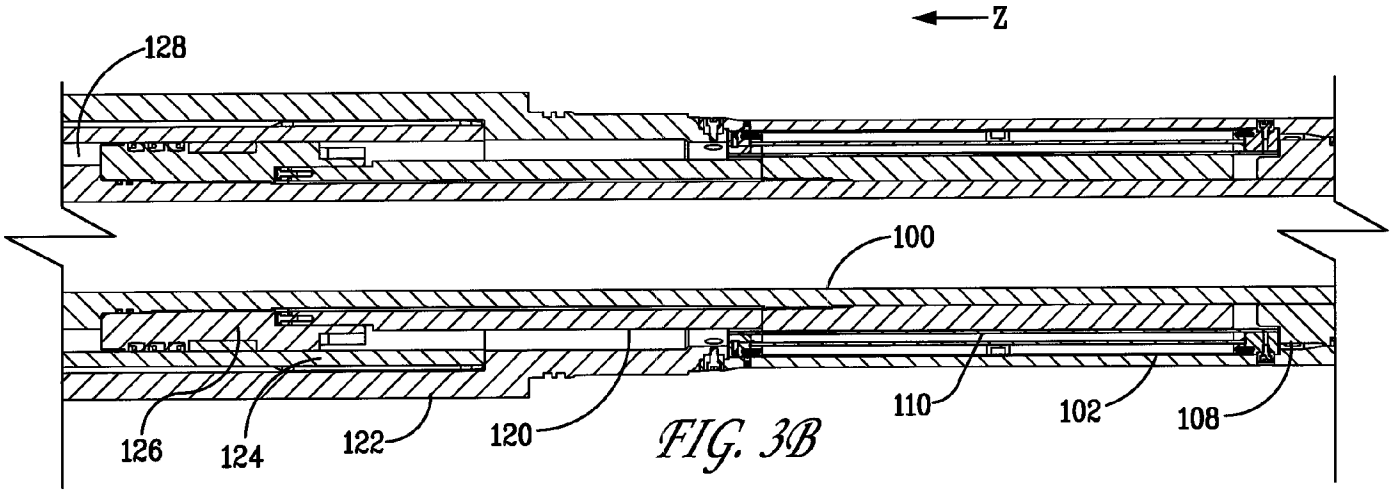
FIGS. 3A, 3B and 3C are detailed views of the portions of the valve assembly shown in FIG. 2.
Figure 3A:
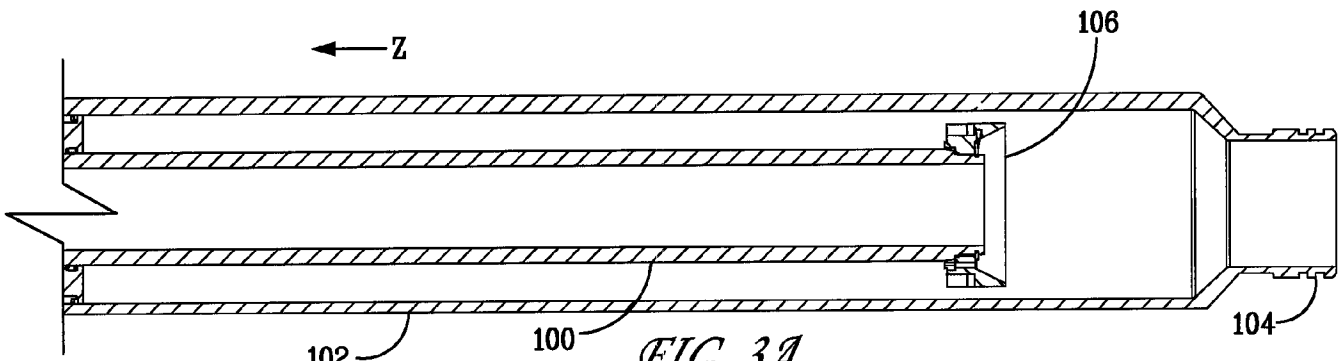

As shown in FIG. 3B, a linear variable displacement transducer (LVDT) 110 is located within the housing 102 between pistons 108 and 126 and spacer 120. The LVDT 110 senses the relative displacement between the uphole housing 102 and the coil mandrel 100 in the axial direction. The LVDT 110 preferably comprises an array of axially-spaced magnetic elements coupled to the housing 102 and a sensor, such as a Hall-effect sensor, mounted on the mandrel 100 so that the sensor is magnetically coupled to the magnetic elements. The LVDT 110, which is explained more fully in aforementioned U.S. Pat. No. 7,219,752, can provide an indication of the relative axial displacement, velocity, and acceleration of the housing 102 and the mandrel 100.

Figure 3C:
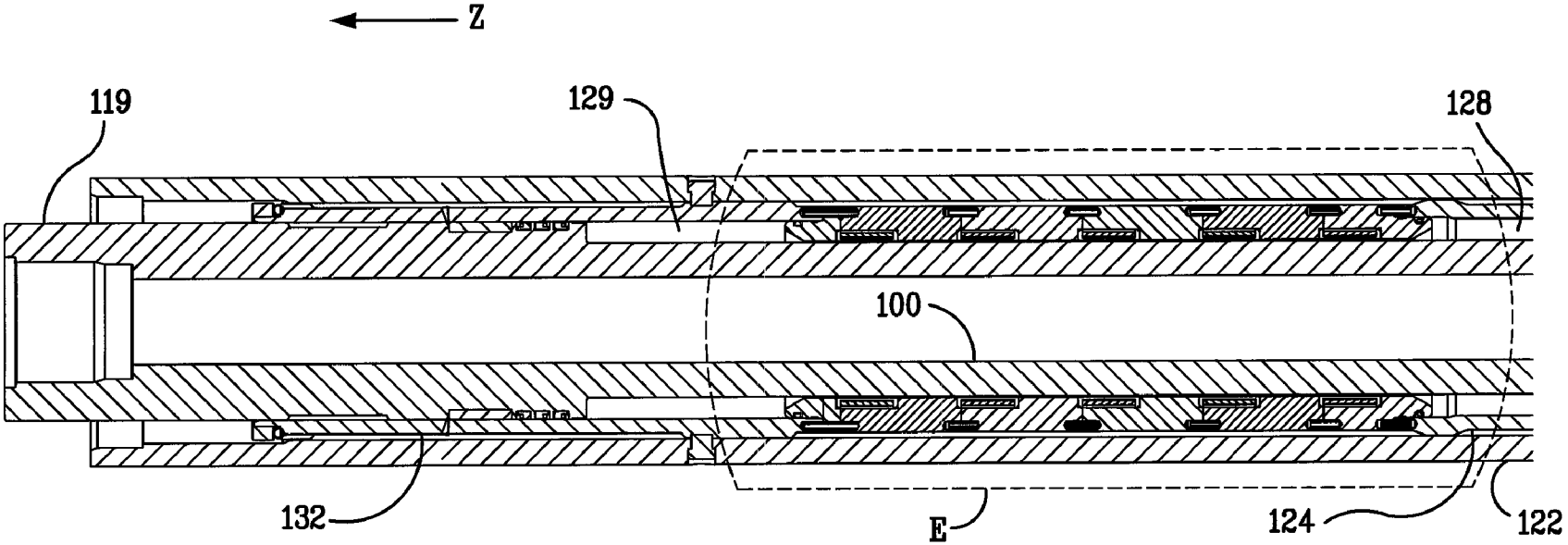

As shown in FIGS. 3B and C, a valve cylinder 124 and a valve cylinder 132 are fixedly mounted with the MR valve housing 122. As shown in FIG. 3C, a coil assembly is located between valve cylinder 124 and valve cylinder 132. A uphole MR fluid chamber 128 is formed between uphole valve cylinder 124 and the mandrel 100. A downhold MR fluid chamber 129 is formed between downhole valve cylinder 132 and the mandrel 100.

Figure 4A:
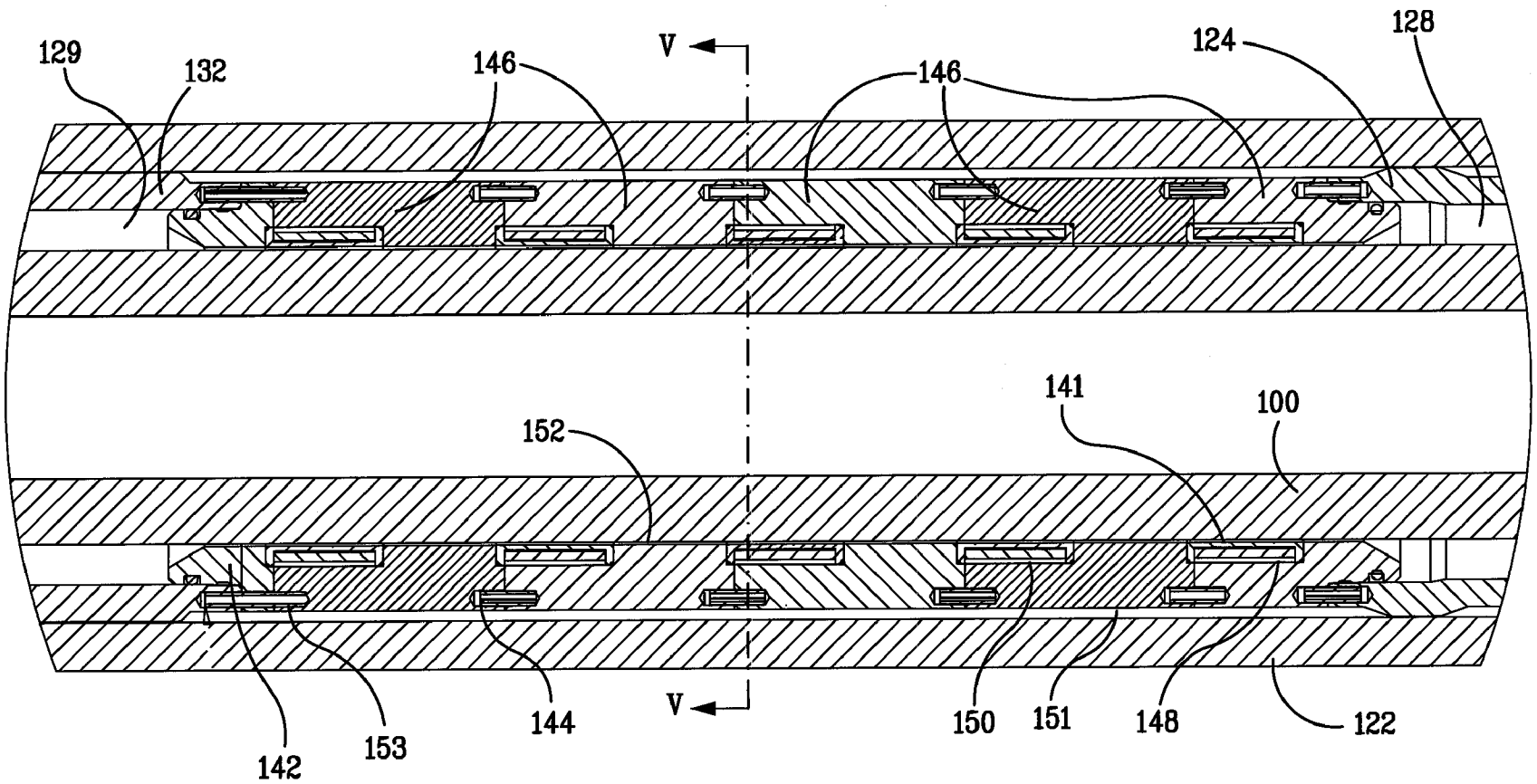
FIGS. 4A and 4B are detailed views of the portion of the valve assembly indicated by E in FIG. 3C, at two different circumferential locations.
Figure 4B:
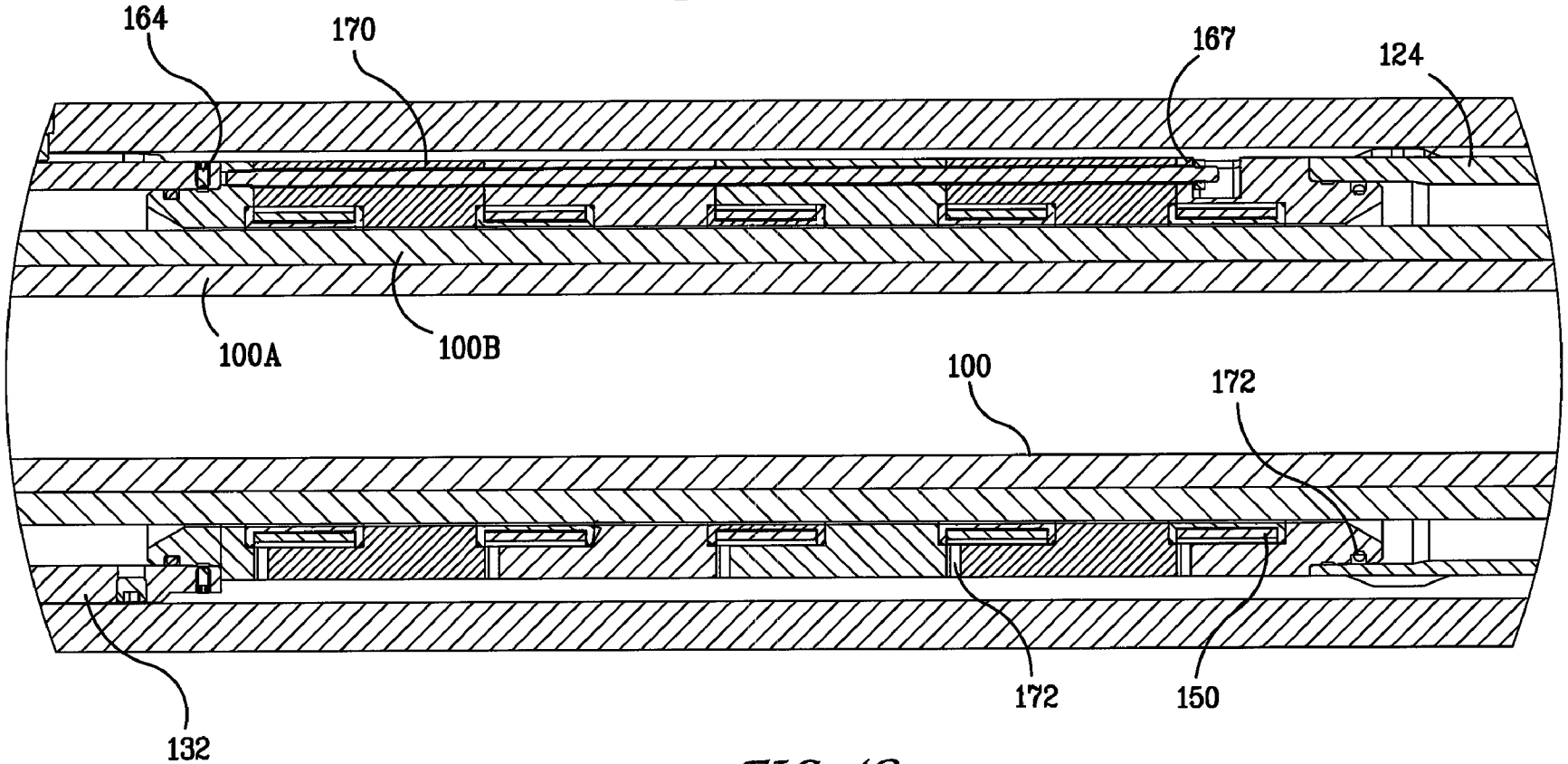
Figure 5:
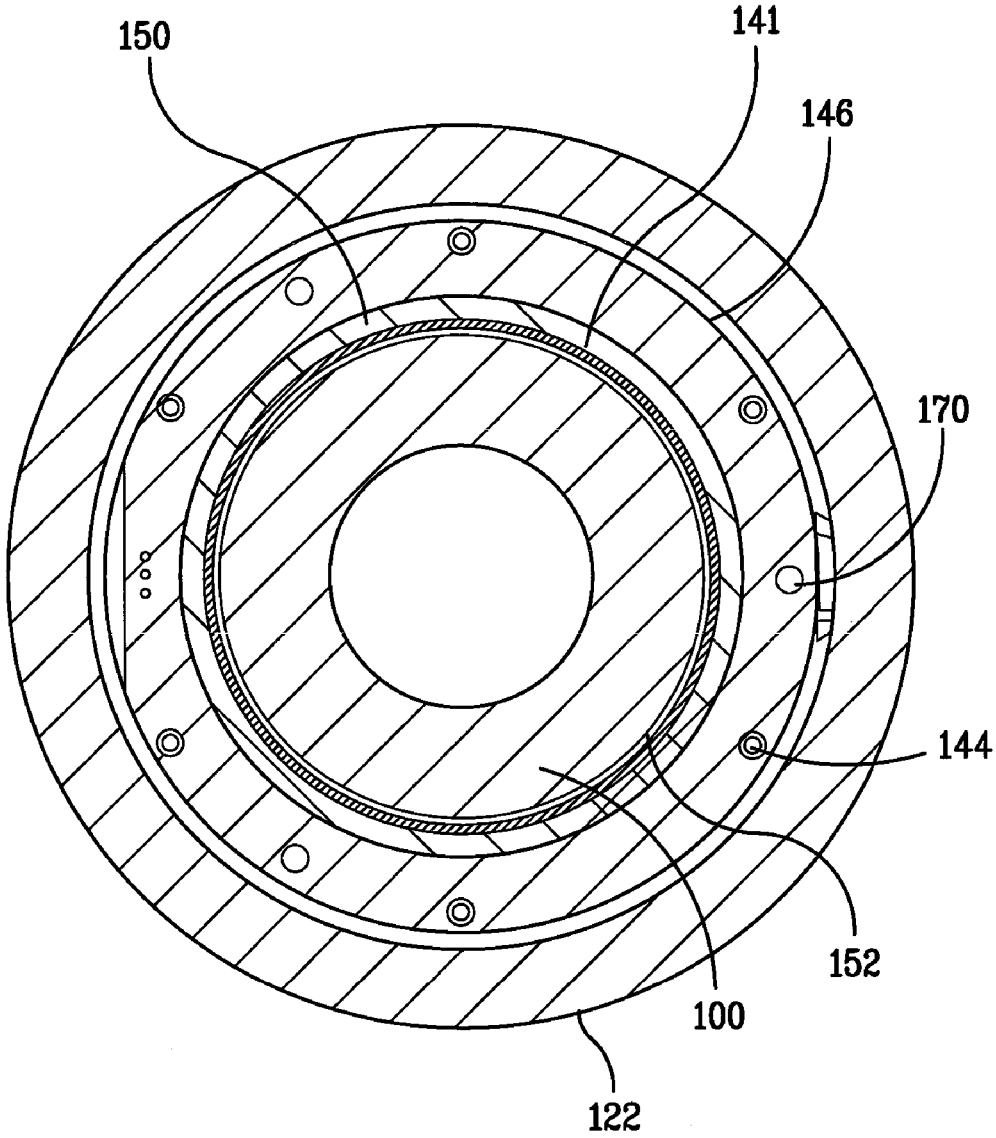
FIG. 5 is a transverse cross-section through the valve assembly along line V-V in FIG. 4A.

As shown in FIGS. 4A, 4B and 5, the coil assembly is comprised of a stack of coil holders 146 and an end cap 142 aligned via pins 144 and 153 to the valve cylinders 124, 132. Thus, the coil holders 146 and end cap 142 are maintained in a fixed relationship to the MR valve housing 122 so that the MR valve housing 122, valve cylinders 124 and 132, and coil holders 146 and end cap 142 form a functional unit relative to which the mandrel 100 reciprocates in response to vibration from the drill bit 13. The coil holders 146 and end cap 142 are held together by threaded rods 170, onto which nuts 164 and 167 are threaded. A slot 148 formed within each coil holder 146 holds a bobbin 141 around which a coil 150 is wrapped. A wire passage 172 formed in each coil holder 146 provides a passage for the coil wire. A circumferential gap 152, shown exaggerated in FIG. 4A, between the coil holders 146 and the mandrel 100 allows MR fluid to flow between the two chambers 128 and 129.

The first and second chambers 128, 129 are filled with a MR fluid. MR fluids typically comprise non-colloidal suspensions of ferromagnetic or paramagnetic particles. The particles typically have a diameter greater than approximately 0.1 microns. The particles are suspended in a carrier fluid, such as mineral oil, water, or silicon. Under normal conditions, MR fluids have the flow characteristics of a conventional oil. In the presence of a magnetic field, however, the particles suspended in the carrier fluid become polarized. This polarization cause the particles to become organized in chains within the carrier fluid. The particle chains increase the fluid shear strength (and therefore, the flow resistance or viscosity) of the MR fluid. Upon removal of the magnetic field, the particles return to an unorganized state, and the fluid shear strength and flow resistance returns to its previous value. Thus, the controlled application of a magnetic field allows the fluid shear strength and flow resistance of an MR fluid to be altered very rapidly. MR fluids are described in U.S. Pat. No. 5,382,373 (Carlson et al.), which is incorporated by reference herein in its entirety. An MR fluid suitable for use in the valve assembly 16 is available from the Lord Corporation of Indianapolis, Ind.

The coil mandrel 100 reciprocates within the MR valve housing 122 and valve cylinders 124, 132 in response to vibration of the drill bit 13. This movement alternately decreases and increases the respective volumes of the first and second chambers 128, 129. In particular, movement of the mandrel 100 in the up-hole direction (to the right in FIG. 4A) increases the volume of the first chamber 128, and decreases the volume of the second chamber 129. Conversely, movement of the mandrel 100 in the down-hole direction (to the left in FIG. 4A) decreases the volume of the first chamber 128, and increases the volume of the second chamber 129. The reciprocating movement of the coil mandrel 100 within the valve housing 122 thus tends to pump the MR fluid between the first and second chambers 128, 129 by way of the annular gap 152.

The flow resistance of the MR fluid causes the MR valve assembly 18 to act as a viscous damper. In particular, the flow resistance of the MR fluid causes the MR fluid to generate a force (opposite the direction of the displacement of the coil mandrel 100 in relation to the valve housing 122) that opposes the flow of the MR fluid between the first and second chambers 128, 129. The MR fluid thereby resists the reciprocating motion of the coil mandrel 100 in relation to the housing 122. This resistance can dampen axial vibration of the drill bit 13. Also, as discussed more fully in the aforementioned U.S. Pat. No. 7,219,752, the torsional bearing assembly 22 converts at least a portion of the torsional vibration of the drill bit 13 into axial vibration of the mandrel 100. Thus, the MR valve assembly 18 is also capable of damping torsional vibration of the drill bit 13.

The magnitude of the damping force generated by the MR fluid is proportional to the flow resistance of the MR fluid and the frequency of the axial vibration. The flow resistance of the MR fluids, as noted above, can be increased by subjecting the MR fluid to a magnetic field. Moreover, the flow resistance can be altered by varying the magnitude of the magnetic field.

The coils 150 are positioned so that the lines of magnetic flux generated by the coils cut through the MR fluid located in the first and second chambers 128, 129 and the gap 152. The current through the coils 150, and thus the magnitude of the magnetic flux, is controlled by a controller 134, which may be located in the power module 14, as shown in FIG. 1. The controller 134 controls the current (power) through the coils 150.

The LVDT 110 provides a signal in the form of an electrical signal indicative of the relative axial position, velocity, and acceleration between the uphole housing 102, and hence the MR valve housing 122, and the coil mandrel 100, which is connected to the drill bit 13. Hence, the output of the LVDT 110 is responsive to the magnitude and frequency of the axial vibration of the drill bit 13. In one embodiment, the LVDT 110 sends information concerning the vibration of the drill bit 13 to the surface for analysis. Based on this information, the drill rig operator can determine whether a change in the damping characteristics of the MR valve 18 is warranted during the next stoppage of the drill bit 13. If so, the operator will send a signal to the controller 134 during the stoppage instructing it to change the power supplied to the coils 150 and thereby alter the magnetic field to which the MR fluid is subjected and the dampening provided by the MR valve 10.

In another embodiment, the controller 134 preferably comprises a computing device, such as a programmable microprocessor with a printed circuit board. The controller 134 may also comprise a memory storage device, as well as solid state relays, and a set of computer-executable instructions. The memory storage device and the solid state relays are electrically coupled to the computing device, and the computer-executable instructions are stored on the memory storage device.

The LVDT 110 is electrically connected to the controller 134. The computer executable instructions include algorithms that can automatically determine the optimal amount of damping at a particular operating condition, based on the output of the LVDT 100. The computer executable instructions also determine the amount of electrical current that needs to be directed to the coils 150 to provide the desired damping. The controller 134 can process the input from the LVDT 110, and generate a responsive output in the form of an electrical current directed to the coils 150 on a substantially instantaneous basis. Hence, the MR valve assembly 18 can automatically vary the damping force in response to vibration of the drill bit 13 on a substantially instantaneous basis—that is, while the drill bit 13 is operating.

Preferably, the damping force prevents the drill bit 13 from losing contact with the drilling surface due to axial vibration. The controller 134 preferably causes the damping force to increase as the drill bit 13 moves upward, to help maintain contact between the drill bit 13 and the drilling surface. (Ideally, the damping force should be controlled so the weight-on-bit remains substantially constant.) Moreover, it is believed that the damping is optimized when the dynamic spring rate of the vibration damping system 10 is approximately equal to the static spring rate. (More damping is required when the dynamic spring rate is greater than the static spring rate, and vice versa.)

In any event, whether done during periodic stoppages of the drill bit 13 or automatically on an essentially instantaneous basis, the ability to control vibration of the drill bit 13, it is believed, can increase the rate of penetration of the drill bit, reduce separation of the drill bit 13 from the drilling surface, lower or substantially eliminate shock on the drill bit, and increase the service life of the drill bit 13 and other components of the drill string. Moreover, the valve assembly and the controller can provide optimal damping under variety of operating conditions, in contra-distinction to shock subs. Also, the use of MR fluids to provide the damping force makes the valve assembly 14 more compact than otherwise would be possible.

Operation of the MR valve 10 by energizing the coils 150 whenever an increase in damping is necessary beyond that provided by the MR fluid that is not subjected to a magnetic field requires a relatively large amount of electrical power since the dc current supplied to the coils may be in excess of 2 amps. At such power levels, battery packs typically used in downhole systems, such as for an MWD system, would only last about twelve hours. Therefore, operation in such a manner is typically done using a turbine alternator as the power module, as discussed in aforementioned U.S. Pat. No. 7,219,752.

According to the invention, the need for continuous electrical power is eliminated by fabricating portions of the MR valve—in one embodiment, the coil holders 146, shaft 100 and end cap 142—from a material that will, overtime, become somewhat essentially "permanently" magnetized to a substantial degree—that is, as a result of being subjected to the magnetic field of the coils 150, they will maintain their magnetism after the magnetic field has been removed. Thus, when the coils 150 are de-energized to a very low state, or turned off completely, the coil holders 146, shaft 100 and end cap 142 may retain a remnant degree of magnetization that will generate a magnetic field maintaining a relatively high viscosity of the MR fluid. Whether or not they become magnetized, portions of the valve that are not proximate the gap 152 through which the MR fluid flows will have little effect on the performance of the damper. The materials for these portions are chosen based on their structural, rather than magnetic properties.

According to the invention, the MR valve 10 is constructed so that some or all of the components of the valve are made from a material having sufficient residual magnetization so that the strength of the residual magnetic field generated by the components is still relatively high when the electrical field inducing the magnetic field, as a result of the dc current through the coils 150, is eliminated. In other words, according to the invention, the residual magnetism phenomenon, which in prior art MR valves created a problem that required a demagnetization cycle to avoid, is intentionally enhanced. When, during initial operation of the MR valve 10, it is desired to increase the damping beyond that afforded by the MR fluid subjected to zero magnetic field, the batteries will supply a current of, for example, 2.5 amps, for a period of time preferably only sufficiently long to create the desired residual magnetization in the valve components, typically less than about 100 milliseconds. After this period of time, the coils 150 are energized to a lower value and the residual magnetic field of the MR valve components is primarily used to create the necessary damping thereafter. Preferably, the coils 150 are completely de-energized and the residual magnetic field of the MR valve components is solely used to create the necessary damping thereafter. According to the invention, the materials from which the valve components are made, as discussed further below, are selected so that the remnant magnetic field is at least about 12,000 Gauss.

If, after a period of time operating at this level of damping, it were determined by the operator or the controller 134 that additional damping was required, the coils 150 would be energized at a higher current than that previously used, for a period of time sufficient to magnetically saturate the parts. This higher current will result in higher residual magnetism in the MR valve components that is then used to provide the additional damping after the coils 150 were again de-energized.

If, still later, it were determined by the operator or the controller 134 that less damping was required, the MR valve components would be subjected to a demagnetization cycle, discussed below, to reduce the residual magnetic field to approximately zero. If the new desired amount damping was less than that resulting from the residual magnetism of the MR valve, but greater than that afforded by the MR fluid at zero magnetic field, the coils 150 would then be temporarily energized as they were during the initial operation to create the desired degree of residual magnetization in the valve components. The coils 150 would then be partially or completely de-energized and the MR valve operated primarily or solely using the residual magnetism of the valve components.

According to one embodiment of the current invention, when desired, this permanent magnetization is removed by periodically using the coils 150 to subject the coil holders 146, shaft 100 and end cap 143, as well as any other MR valve components subject to being permanently magnetized, to a demagnetization cycle. Specifically, the controller 134 includes circuitry, shown in FIG. 6, that was previously used in prior art MR valves to eliminate unwanted permanent magnetization. This circuitry, through which the dc electrical current from the power module 14 passes, converts the dc current into current of alternating polarity and decreasing amplitude in a stepwise fashion. During magnetization, or when the remnant magnetic field is to be left undisturbed, the current flows only in one direction, whereas when demagnetization is desired, reversing polarity is obtained.

Figures 6, 6A:
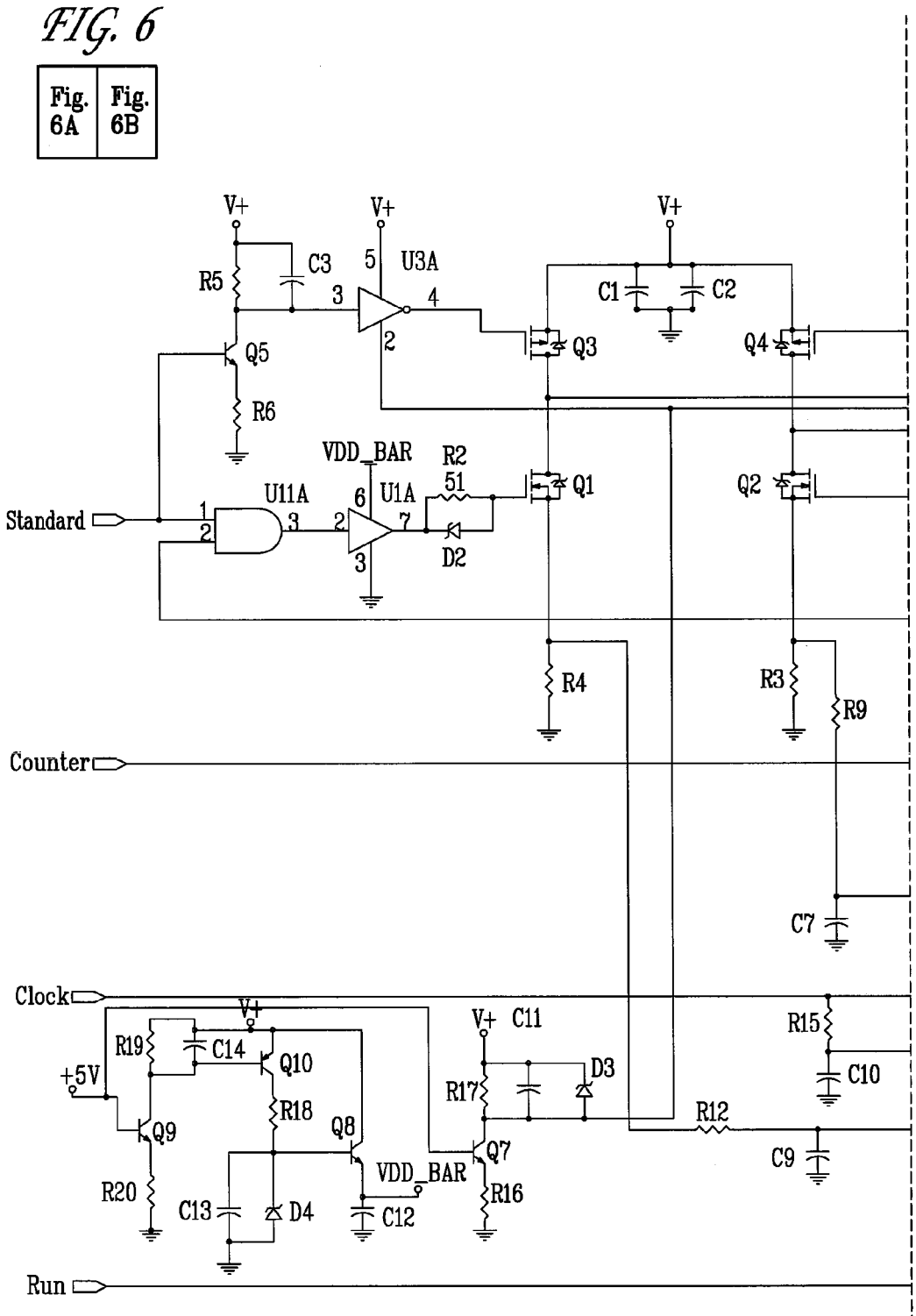
FIGS. 6A and 6B are schematic diagrams of a preferred embodiment of the circuitry for controlling power to the coils.
Figure 6B:
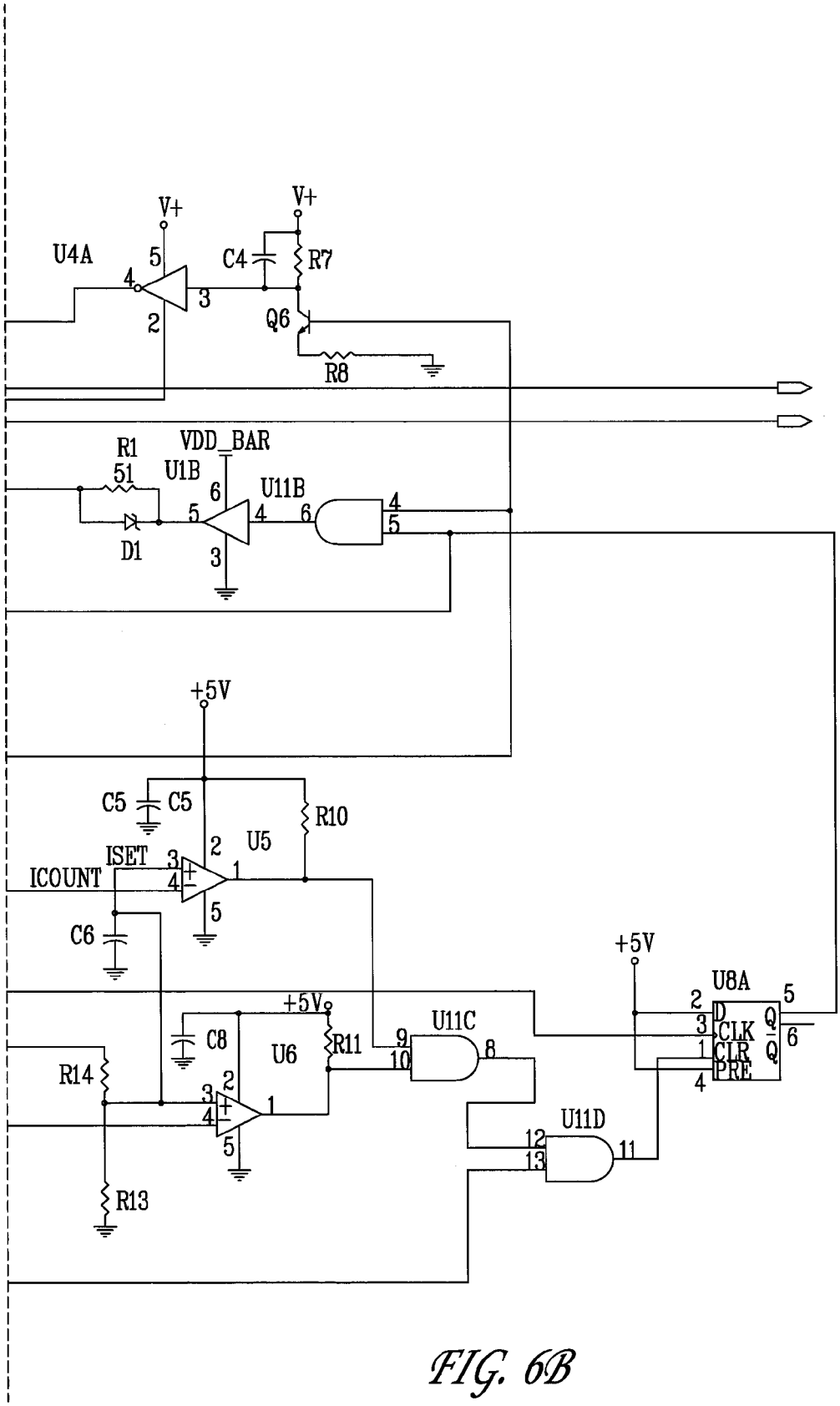
Figure 6C:
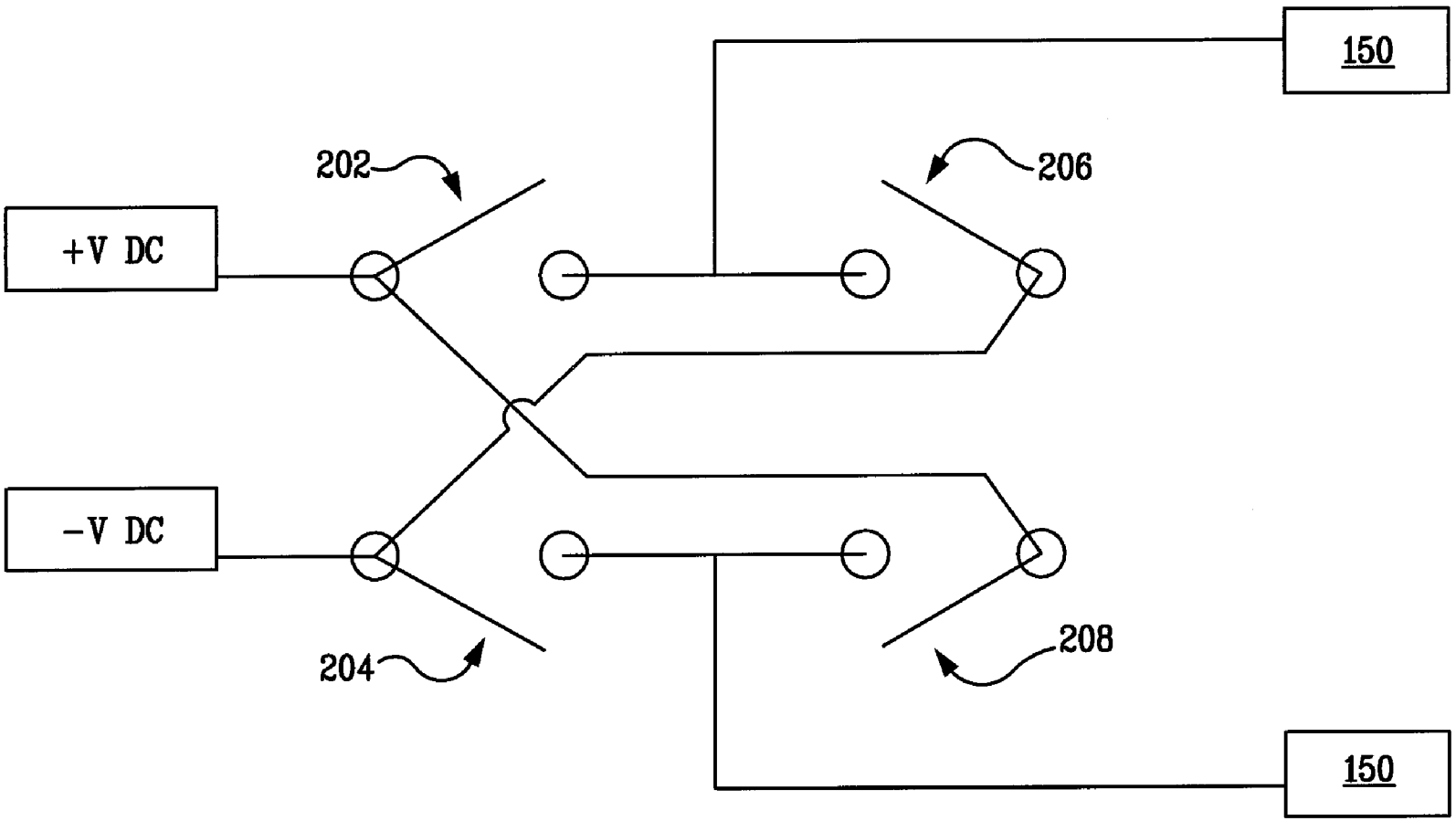
FIG. 6C is a simplified schematic diagram of circuitry for controlling power to the coils.

As shown in FIG. 6C, which is a simplified diagram of the circuitry shown in FIGS. 6A and B, the switches 202 and 204 work as a pair and switches 206 and 208 work as a pair. When 202 and 204 are switched, the upper coil 150 in FIG. 6C receives a positive voltage and the lower coil 150 receives a negative voltage. When switches 206 and 208 are energized, the coil polarity is reversed so the upper coil 150 receives a negative voltage and the lower coil 150 receives a positive voltage. In this way, reversing polarity is obtained. The software switches the pairs in a break-before-make sequence to ensure that the switch does not just short out because having both pairs of switches on at the same time would connect the plus and minus supplies through the switch with enough current draw to possibly do damage.

To control the voltage in a stepwise fashion a process known as Pulse Width Modulation is used (PWM). To accomplish this, the switch pairs are switched on and off very fast, typically operating at several hundred to several thousand hertz. The percentage of on-time versus off-time essentially scales the voltage by that percentile. For example, if the supply voltage is 40 VDC and the duty cycle is 50% the effective voltage on the coil is 20 VDC. The electronics and the coil inductance filter the modulated signal and smooth out the pulses to a steady DC at a lower value than the supply. This allows the gradually scaling down of the supply voltage from full-on (i.e., 100% duty cycle, switches always on) to near zero (i.e., 5% duty cycle, switch on for a very short time but off for the majority of the time).

Figure 7:
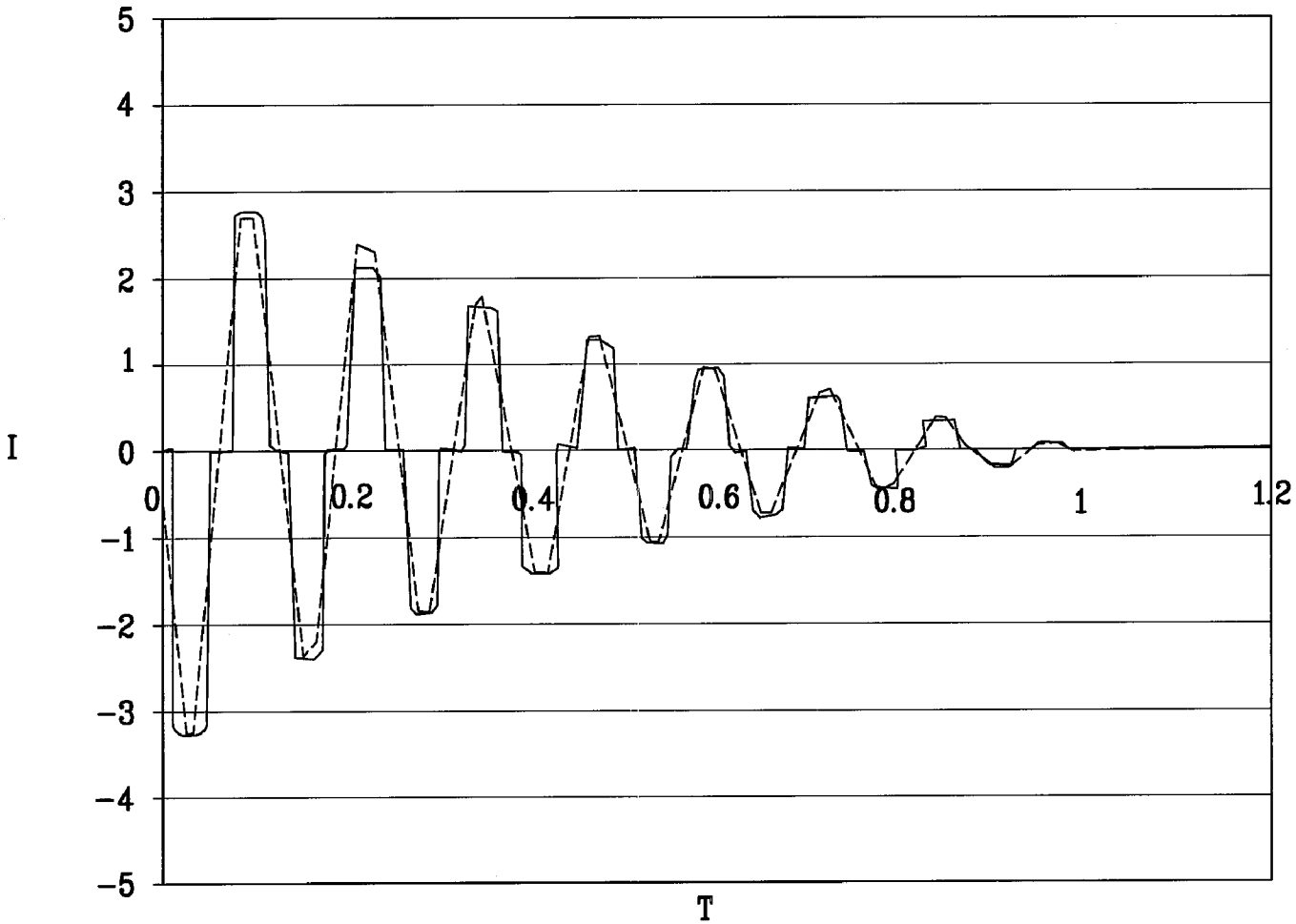
FIG. 7 is a graph of current, I, in amps, supplied to the coils versus time, T, in seconds, for a demagnetization cycle according to the current invention.

A typical prior art demagnetization cycle is shown in FIG. 7. After the coils are energized for period of time, an undesirable degree of residual magnetization may persist in the coil holders 146 and the end cap 142. Consequently, the coils 150 are energized according to the cycle shown in FIG. 7 in which the dc current reverses polarity and decreases in a stepwise fashion until it reaches a low current before diminishing to zero. Preferably, the demagnetization cycle is capable of reducing the remnant magnetic field to approximately zero.

In one typical embodiment, the duration of each step in the demagnetization cycle is about 0.06 second and the time between initiations of each step is about 0.1 second so that there is a slight "rest" period between each polarity reversal. The total number of steps is typically about sixteen so that the total time required for the demagnetization cycle is less than about two seconds. However, as will be apparent to those skilled in the art, other demagnetization cycles could also be utilized, provided the number and length of the steps is sufficient to reduce the remnant field to a low value, preferably, essentially zero. After demagnetization, completely de-energizing the coils will result in obtaining the minimum damping associated with non-magnetized MR fluid.

Although the use of current of alternating polarity and decreasing amplitude in a stepwise fashion in order to demagnetize the valve components is preferred, other demagnetization methodologies could also be utilized.

Figure 8A:
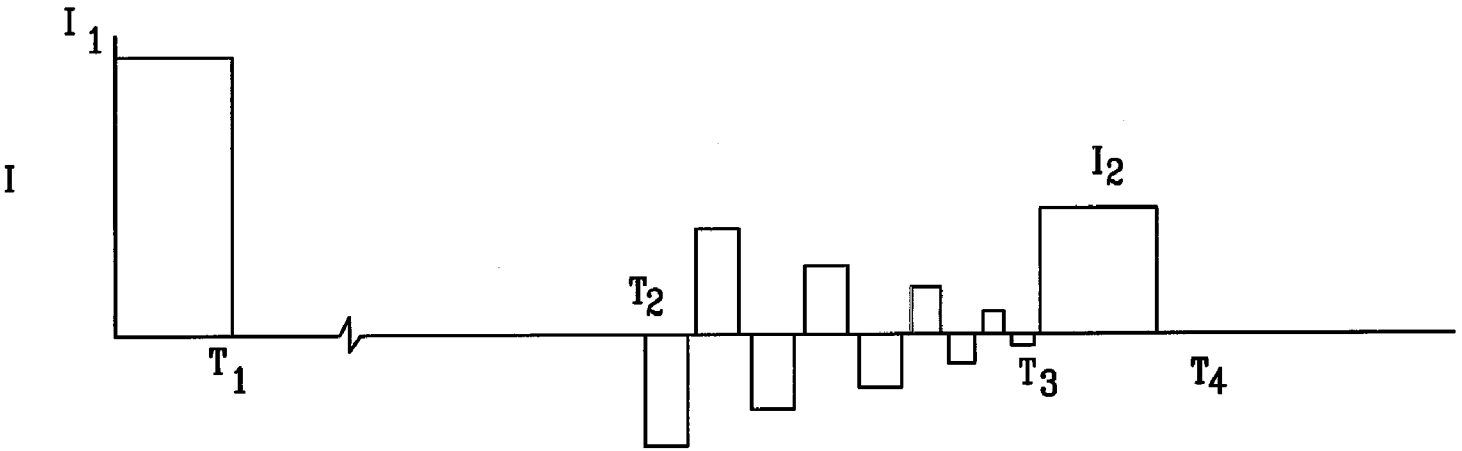
FIG. 8(*a*) is a graph of current, I, supplied to the coils versus time, T, in an operating mode that includes a demagnetization cycle and the use of remnant magnetization to create damping.
Figure 8B:
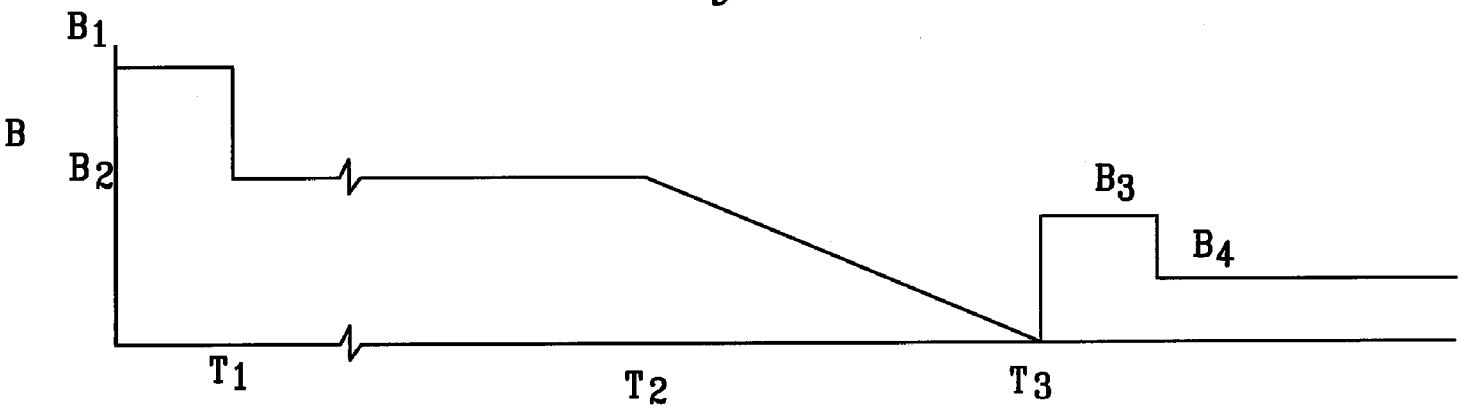

Operation of the MR valve 18 according to the invention is illustrated in FIGS. 8(*a*) and (*b*). Initially, it is determined that in order to obtain the desired degree of damping, the strength of the magnetic field to which the MR fluid is subjected should be $B_2$. However, the coils are initially energized to current $I_1$ so as to generate a higher magnetic field having strength $B_1$ for a period of time $T_1$ sufficient to induce a remnant magnetic field of strength $B_2$ in one or more components of the MR valve. Magnetic field having strength $B_1$ may, for example, be sufficient to induce saturation magnetization in the components of the MR valve so as to obtain the maximum subsequent remnant magnetic field. After time $T_1$, the coils are de-energized and the MR valve operated on the remnant magnetic field $B_2$ supplied by the components of the MR valve. The current invention allows the remnant magnetic field $B_2$ to be substantially greater than that obtainable when using prior art MR valves made with components of 12L14 low carbon steel and 410/420 martensitic stainless steel, which can obtain only relatively low remnant magnetization.

If at time $T_2$ it is determined that less damping is required, a demagnetization cycle is initiated. At the completion of the demagnetization at time $T_3$, the coils are energized to current $I_2$ so as to generate a magnetic field having strength $B_3$ for a period of time sufficient to induce a remnant magnetic field of strength $B_4$ in one or more components of the MR valve. Thereafter, the coils are de-energized at time $T_4$ and the MR valve operated using the remnant magnetic field of strength $B_4$ from the components of the MR valve. Significantly, no electrical power is supplied to the coils 150 between $T_1$ and $T_2$ and subsequent to $T_4$.

Alternatively, the demagnetization cycle shown in FIG. 8 could be adjusted—for example, the number of steps and the current used in the final step, so as reduce the remnant magnetic field directly to the desired value without going down to zero remnant magnetization and then back up to the desired state. After the partial demagnetization cycle, the coils would be de-energized and the MR valve operated using its residual magnetism. Operation in this manner is illustrated in FIGS. 9(*a*) and (*b*).

Figure 9A:
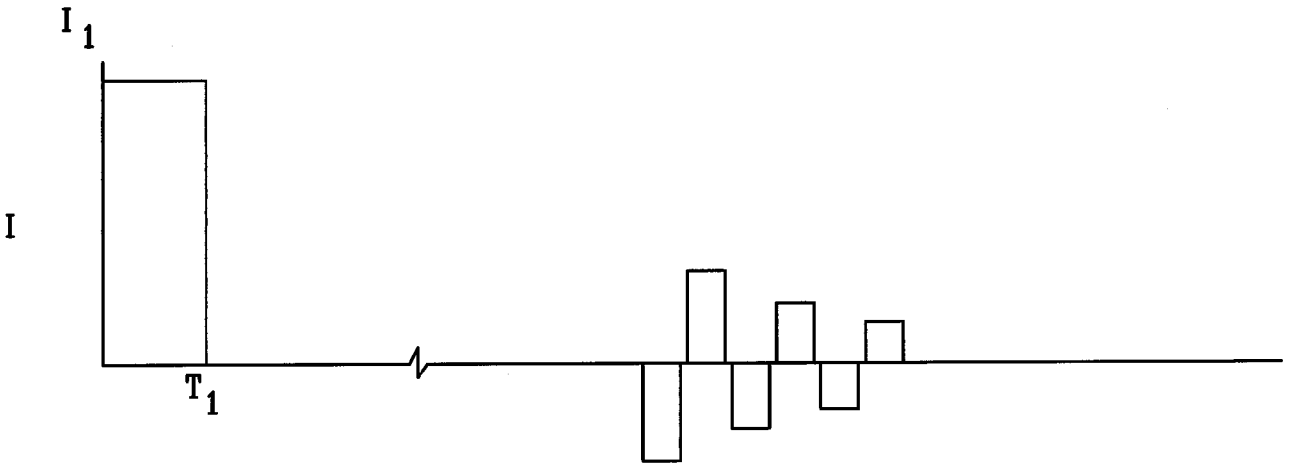
FIGS. 9(*a*) and (*b*) illustrate operation similar to FIGS. 8(*a*) and (*b*) but with a partial demagnetization cycle.
Figure 9B:
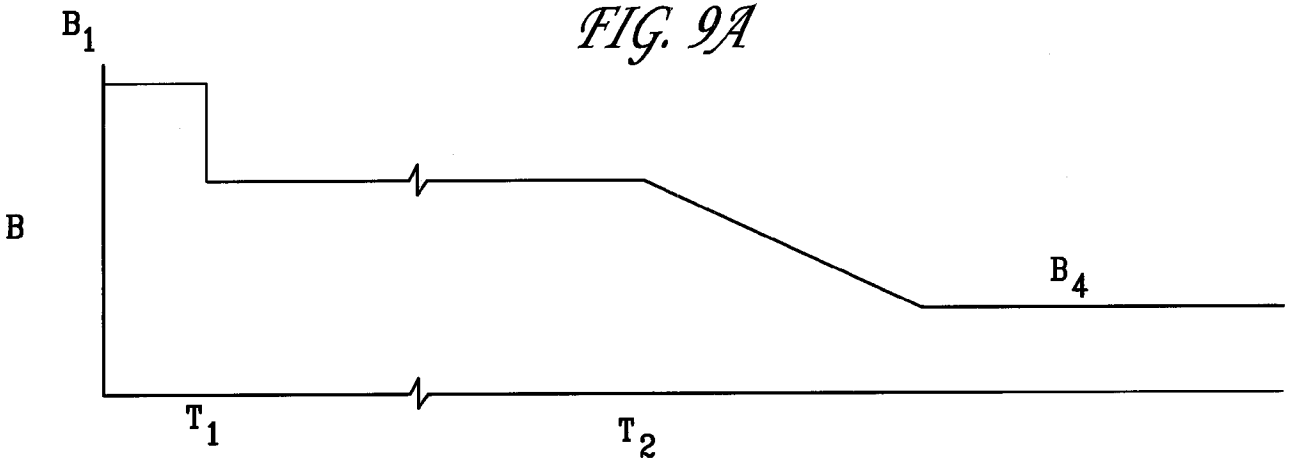

In the embodiment operated as illustrated in FIGS. 8 and 9, the MR valve is operated largely on residual magnetism, with power preferably being supplied to the coils 150 only as necessary to increase or decrease the amount of damping resulting from remnant magnetization of the MR valve components. As a result, the power supply module 14 can consist of a conventional downhole battery pack, without the need to incorporate a turbine alternator. Preferably, the battery pack comprises a number of high-temperature lithium batteries of a type well known to those skilled in the art. Thus, the use of the demagnetization cycle according to the current invention allows one to use an MR valve subject residual magnetization greater than that which created problems in prior art MR valves and to do so in such a way as to gain the unexpected benefit of reduced power consumption.

According to one embodiment of the invention, a feedback loop is incorporated to monitor the strength of the magnetic field in order to determine when the strength of the magnetic field drops below a value specified by the drill rig operator, or determined by the controller 134 if the MR valve is under the automatic control, thereby indicating the need to reenergize the coils 150. A circuit for measuring the strength of the magnetic field in the valve using one or more Hall effect sensors 304, such as Honeywell SS495A, located on the MR valve is shown in FIG. 10.

Figure 10:
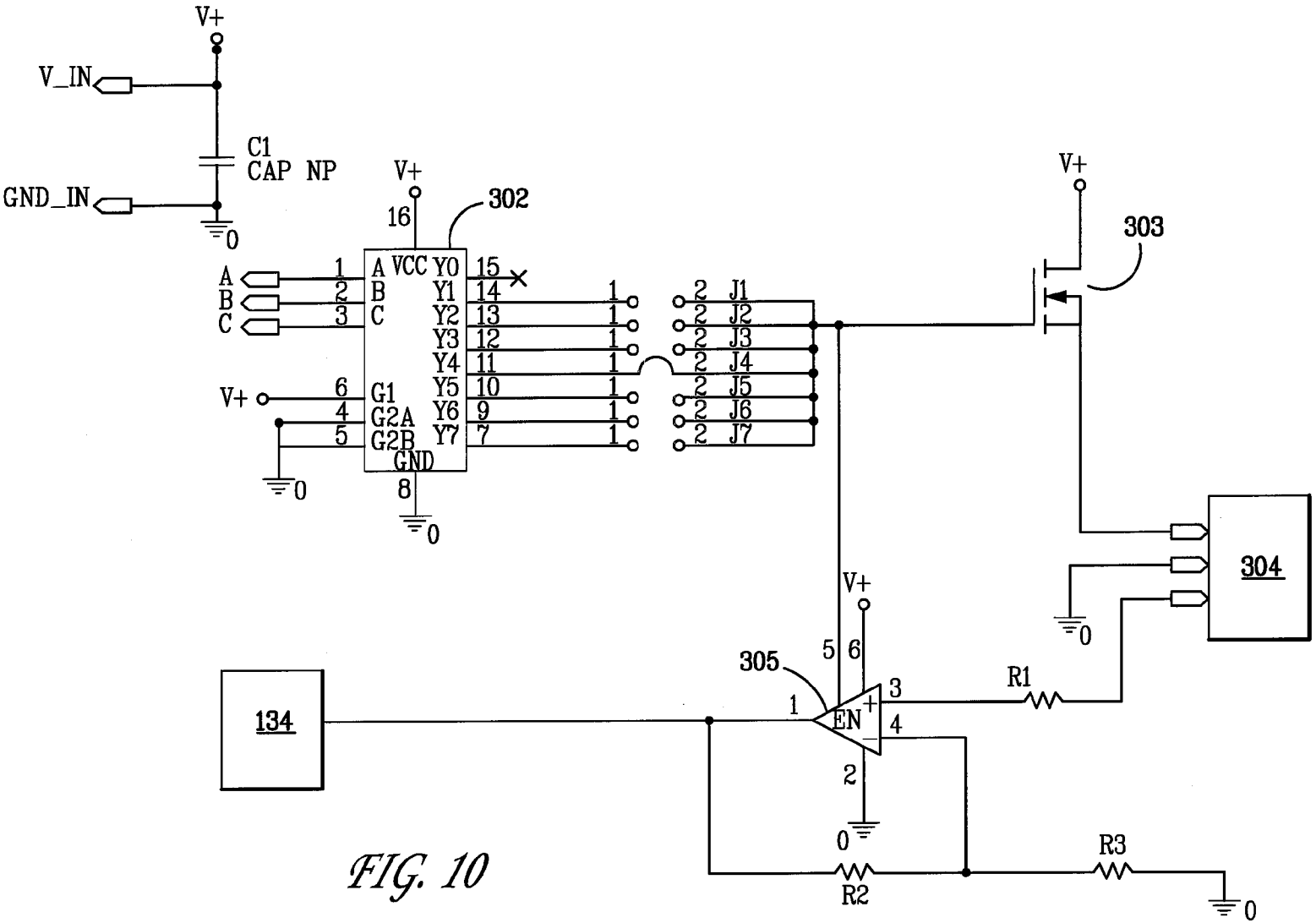
FIG. 10 is schematic diagram of a feedback loop for controlling the power to the coils.

As shown in FIG. 10, the circuit has five inputs and one output, two of the inputs are power and ground, the other three are digital address signals that allows multiple circuits to be distributed within the tool and individually turned on and measured remotely. In this embodiment, up to seven of these circuits can be distributed within the MR valve each with its own address as defined by the jumper settings (J1 through 7 on the schematic in FIG. 10). A demultiplexor circuit 302, such as Texas Instruments CD74AC238, is used to take a signal from the three input lines (A, B, and C) and turn on the specific jumper that corresponds with that combination of high and low values on A, B, and C (for example A=high, B=low, C=low turns on jumper J1; A,B,C all high would turn on J7). The signal from the demultiplexor 302 (i) turns on a field effect transistor 303, such as BSS138/SOT, which provides power to the Hall effect sensor 304, and (ii) enables the operational amplifier 305, such as OPA373AIDBV.

The signal from the Hall effect sensor 304 is fed into the operational amplifier 305, which acts as a buffer with unity gain (R1=1K Ohm, R2=0 Ohm, and R3=infinite resistance). Alternatively, R2 and R3 could be used to boost the voltage by changing the resistance values but would not generally be required due to the stable output of the Hall effect sensor 304. The operational amplifier 305 allows the outputs from all seven circuits to be tied together so only a single signal goes back to the controller 134, thus saving valuable pins in the connector structure of the tool and utilizing only one of the few available A/D inputs to the microprocessor.

The purpose of the demultiplexor 302 is first to minimize the number of pins and Analog to digital (A/D) inputs required to feed back to the microprocessor (three digital outputs and one analog input, as opposed to five A/D inputs to look at individual hall effect sensors), and also to minimize the power draw. The power draw for Hall effect sensors 304 may be relatively very high—in one embodiment, 7 to 8 mAmps each. The maximum power draw for the demultiplexor 302 in this embodiment is 160 μAmps. As a result, there is a power savings of 4,400%, which allows the battery powering the circuit to last forty four times longer. The five distributed circuits in total draw 1/10 the power of a single Hall effect sensor. Thus the Hall effect sensors are only powered up briefly and only when the microprocessor is making a reading, also only one Hall effect sensor is on at a time so the power draw is minimized.

In operation, the controller 134 is programmed to poll the Hall effect sensors 304 one at a time, get an average value representative of the strength of the magnetic field in the MR valve, and compare it to the value specified by the operator or controller 134. The controller 134 is programmed to reenergize the coils 150 so as to re-magnetize the valve if this comparison indicates that the strength of the measured magnetic field deviates from the specified value by more than a predetermined amount. The controller 134 is programmed to perform this polling approximately every minute or so, unless the information received from the LVDT dictated a change in strength of the magnetic field, in which case the Hall effect sensors would be polled again after the magnetic field has been readjusted to determine if the magnetization was at the proper power.

Figure 11:
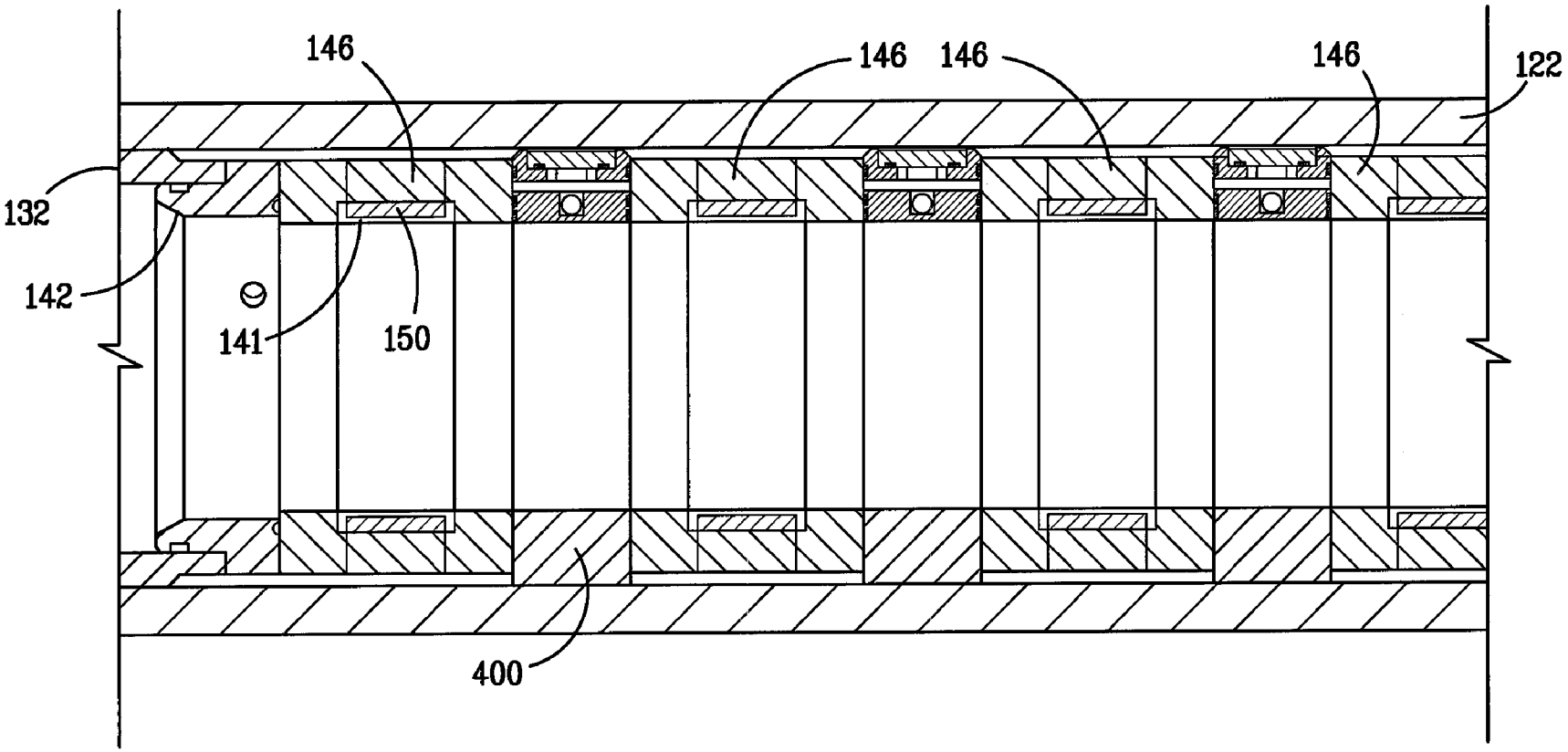
FIG. 11 is a longitudinal cross-section similar to that shown in FIG. 4C showing an alternate embodiment of the invention incorporating the feedback loop shown in FIG. 10.
Figure 12:
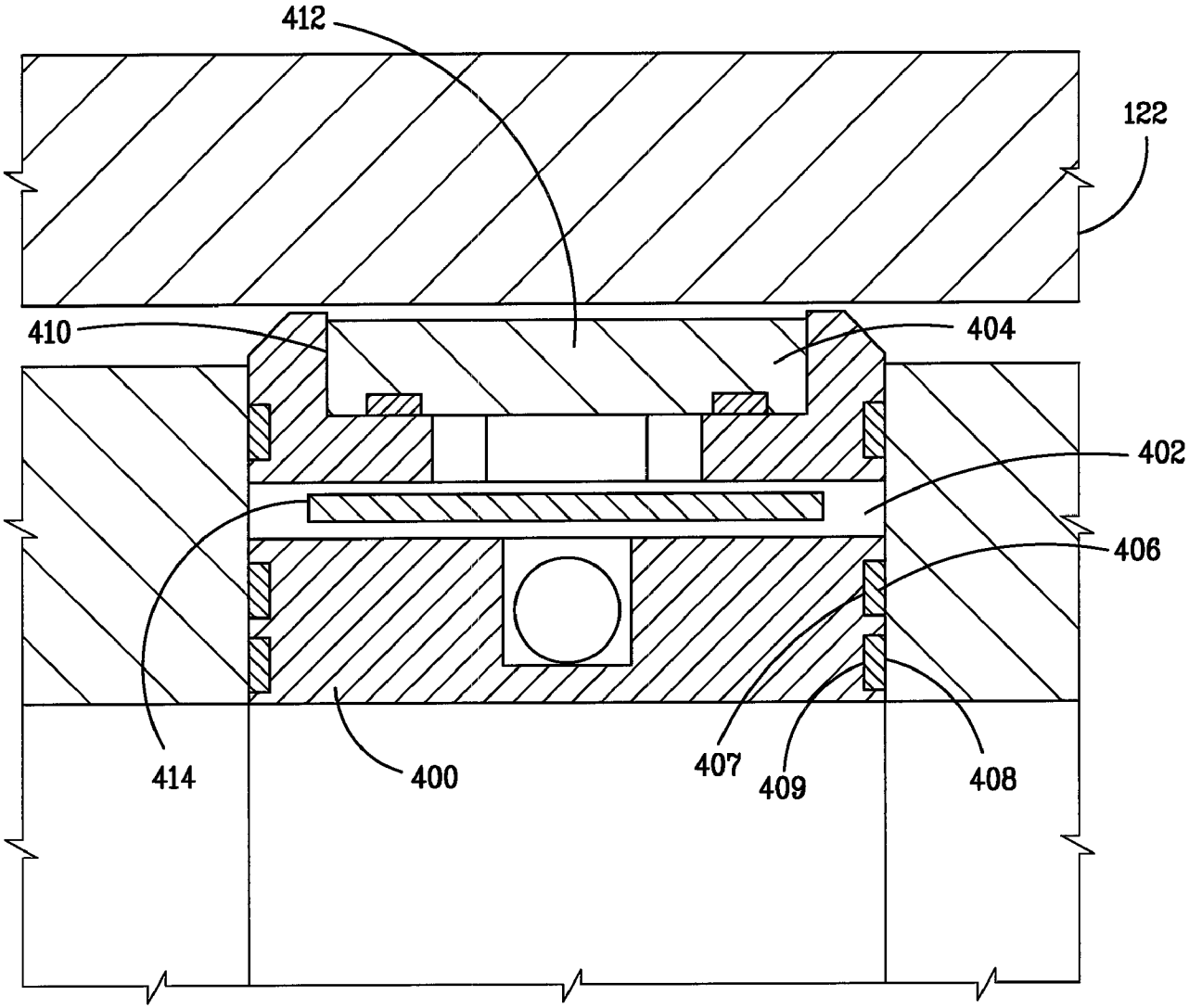
FIG. 12 is a detailed view of the sensor ring portion of FIG. 11.
Figure 13:
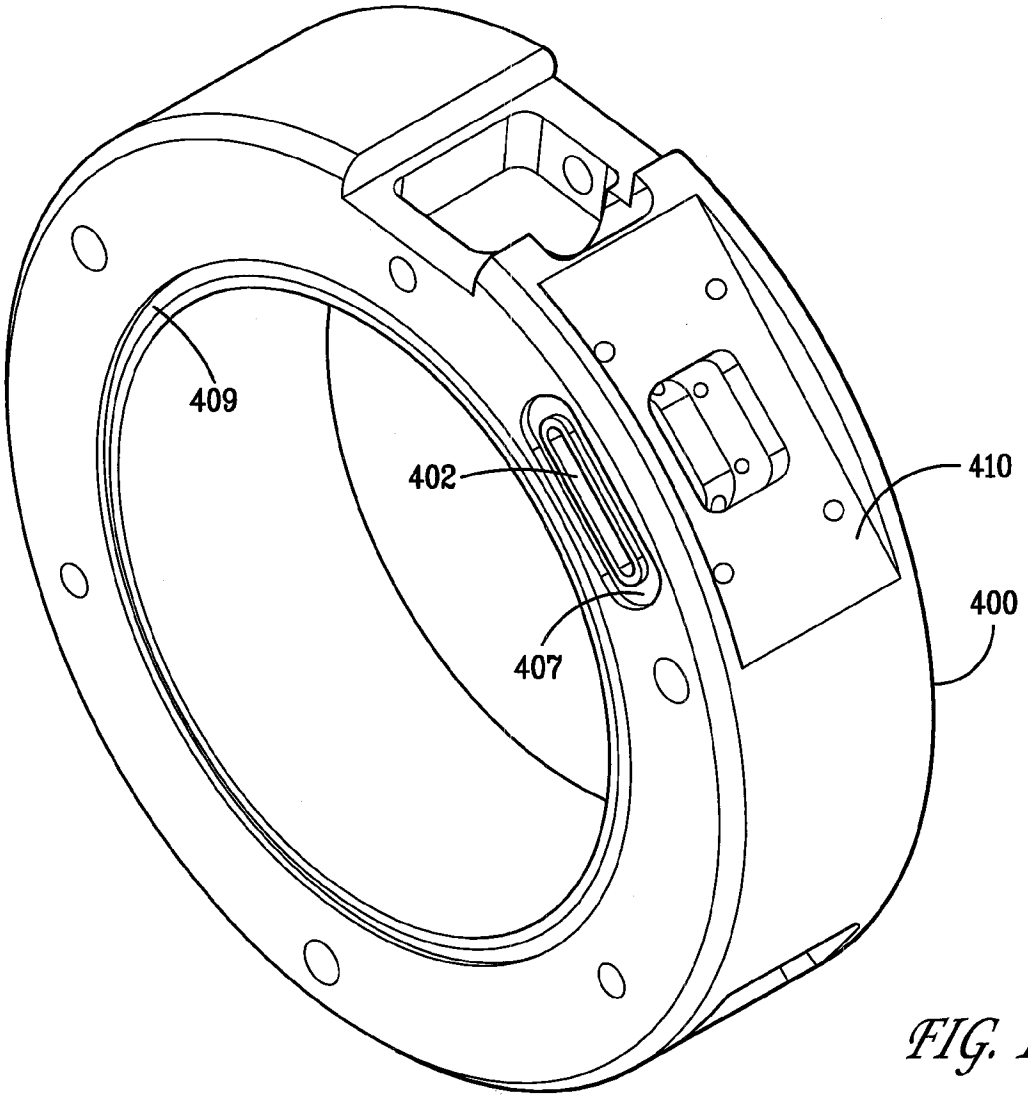
FIG. 13 is an isometric view of the sensor ring shown in FIG. 12.

FIGS. 11-13 show an embodiment incorporating the feedback loop control shown in FIG. 10. As shown in FIG. 11, in this embodiment, sensor rings 400 are placed between each pair of coil holders 146. The sensor rings 400 are preferably made from a non-magnetic material such as spinodal copper nickel tin alloy, such as Toughmet 3 available from Brush Wellman Company. As shown in FIGS. 12 and 13, a printed circuit board 414, which contains the electronics for the feedback loop control shown in FIG. 10, is mounted within a slot 402 in each sensor ring 400. The slot 402 is sealed by a race track O-ring 408 in groove 407 and a circular O-ring 408 in groove 409. A cover 412 is mounted in a recess 410 in the circumference of the sensor ring 400 that allows access to the board 414.

As used herein (i) "saturation magnetization" refers to the maximum magnetic flux density of the material such that any further increase in the magnetizing force produces no significant change in the magnetic flux density, measured in Gauss; (ii) "remnant" or "residual" magnetization or magnetic field refers to the magnetic flux density remaining in the material after the magnetizing force has been reduced to zero, measured in Gauss; (iii) "maximum remnant" magnetization refers to the remnant magnetization of a material after it has experienced saturation magnetization; (iv) "coercivity" refers to the resistance of the material to demagnetization, measured in Oersteds (Oe) and is related to the coercive force, which is the value of the magnetic force that must be applied to reduce the residual magnetization to zero; and (v) magnetic permeability refers to the "conductivity" of magnetic flux in a material, it is expressed as relative magnetic permeability, which is the ratio of the permeability of the material to the permeability of a vacuum.

To facilitate operation as described above, components of the MR valve 18 that are intended to create the remnant magnetic field—in one embodiment, the coil holders 146 and the end cap 142—are made from a material having a maximum remnant magnetism that is substantially greater than that of the 12L14 low carbon steel and 410/420 martensitic stainless steel used in prior art MR valves so that the maximum damping achieved at zero power to the coils 150 is relatively high. Preferably, the material should have a maximum remnant magnetization that is at least 12,000 Gauss. Optimally, the material has a maximum remnant magnetization that is sufficient to saturate the MR fluid—that is, that the magnetic field applied to the MR fluid by the remnant magnetization of the material is such that any further increase in the magnetic field would cause no further increase in the viscosity of the MR fluid—so as to achieve the maximum range of operation possible using remnant magnetization. Ideally, the material should have a high remnant magnetization relative to the saturation magnetization. Preferably the maximum remnant magnetization should be at least about 50%, and more preferably at least about 70%, of the saturation magnetization. Preferably, the material should also have a relatively low coercivity so that power necessary to demagnetize the components is relative low but not so low that the material will become easily unintentionally demagnetized during operation. Preferably, the material should have a coercivity in the range of at least about 10 Oe but not more than about 20 Oe, and most preferably about 15 Oe. The material should also have good corrosion resistance.

Grade 1033 mild steel, preferably with minimal impurities, which has a saturation magnetization of about 20,000 Gauss, a maximum remnant magnetization of about 13,000 to 15,000 Gauss, and a coercivity of about 10 to 20 Oe, is one example of a material suitable for use in the components of the MR valve intended to be operated as described above using primarily remnant magnetization. Ferritic chrome-iron alloys are another example of suitable materials. Examples of such ferritic chrome alloys are described in U.S. Pat. No. 4,994,122 (DeBold et al), hereby incorporated by reference in its entirety. Carpenter Chrome Core 8 alloy, available from Carpenter Technology Corporation, which has a saturation magnetization of 18,600 Gauss, a maximum remnant magnetization of 13,800 Gauss (74% of saturation) and a coercivity of 2.5 Oe may also be a suitable material for many MR valves.

Preferably, the components of the MR valve made from the materials described above are capable of applying a magnetic field to the MR fluid, solely as a result of remnant magnetization, that is of sufficient strength to magnetically saturate the MR properties of the particular fluid.

Preferably, the shaft 100 is made at least in part from a material having a high permeability so as to facilitate magnetic flux through the MR valve. Preferably the material has a relative permeability of at least about 7000. It is also desirable for the material to have a low coercivity, preferably less than 1.0, so that it can be easily demagnetized and remagnetized as it moves within the magnetic field without creating a sufficiently strong magnetic field to demagnetize other portions of the valve. As shown in FIG. 4B, the shaft 100 can be formed with an inner shell 100A made from a corrosion resistant material, such as 410/420 stainless steel, so as to withstand contact with the drilling mud, and an outer shell 100B made from a material having a high magnetic permeance. One material that may be used for the outer shell 100B is Permalloy, which has a relative permeability of over 100,000, a saturation magnetization of about 12,000 Gauss, and a coercivity of about 0.05 Oe. A silicon iron, which a relative permeability of about 7,000, a saturation magnetization of about 20,000 Gauss and a coercivity of about 0.05 Oe, could also be used in many applications.

Although as shown in the drawings, the coil 150 is mounted in the casing 122 that transmits the drilling torque, the invention could also be practice by mounting the coils in the shaft 100. In that arrangement, at least a portion of the shaft 100 would be made from a material having a remenant magnetization of at least 12,000 Gauss and at least a portion of the casing 122 would be made from a material having a high permeance, such as Permalloy, as discussed further below.

Although the invention has been described with reference to a drill string drilling a well, the invention is applicable to other situations in which it is desired to control damping. Accordingly, the present invention may be embodied in other specific forms without departing from the spirit or essential attributes thereof and, accordingly, reference should be made to the appended claims, rather than to the foregoing specification, as indicating the scope of the invention.

What is claimed:

1. In a damping system for damping vibration in a down hole portion of a drill string, said damping system comprising a magnetorheological (MR) valve containing an MR fluid subjected to a magnetic field created by at least one coil, said MR fluid flowing through a passage formed in said MR valve, a method of operating said MR valve comprising the steps of:

a. energizing said coil of said MR valve for a first period of time so as to create a first magnetic field that alters the viscosity of said MR fluid, said first magnetic field being sufficient to induce a first remnant magnetization in at least one component of said MR valve proximate said passage, said first remnant magnetization being at least about 12,000 Gauss;

b. substantially de-energizing said coil for a second period of time following said first period of time so as to operate said MR valve using said first remnant magnetization in said at least one component of said MR valve to create a second magnetic field that alters the viscosity of said MR fluid;

c. subjecting said at least one component of said MR valve to a demagnetization cycle over a third period of time so as to reduce said first remnant magnetization of said at least one component of said MR valve to a second remnant magnetization;

d. operating said MR valve for a fourth period of time after said demagnetization cycle in step (c).

2. The method according to claim 1, wherein the magnetic field associated with said first remnant magnetization is sufficient to magnetically saturate said MR fluid.

3. The method according to claim 1, wherein said at least one component of said MR valve in which said first remnant magnetization is induced is made from a material having a maximum remnant magnetization of at least about 13,000 Gauss.

4. The method according to claim 1, wherein said at least one component of said MR valve in which said first remnant magnetization is induced is made from a material having a coercivity of at least about 10 Oe.

5. The method according to claim 4, wherein said at least one component of said MR valve in which said first remnant magnetization is induced is made from a material having a coercivity of not more than about 20 Oe.

6. The method according to claim 1, wherein said at least one component of said MR valve in which said first remnant magnetization is induced is made from a material having a coercivity of not more than about 20 Oe.

7. The method according to claim 1, wherein said demagnetization step comprises energizing said at least one coil in steps of decreasing current and alternating polarity.

8. The method according to claim 1, wherein said demagnetization step comprises the steps of:

e. supplying a dc current;

f. converting said dc current into steps of decreasing current and alternating polarity; and g. directing said decreasing current of alternating polarity to said at least one coil.

9. The method according to claim 1, wherein said second remnant magnetization is approximately zero.

10. The method according to claim 1, wherein step (d) of operating said MR valve for said fourth period of time after said demagnetization cycle comprises operating said MR valve using said second remnant magnetization in said at least one component of said MR valve to create a third magnetic field that alters the viscosity of said MR fluid.

11. The method according to claim 1, wherein step (d) of operating said MR valve for said fourth period of time after said demagnetization cycle comprises energizing said coil of said MR valve at a point in time during said fourth period of time so as to create a magnetic field that alters the viscosity of said MR fluid.

12. The method according to claim 1, wherein step (d) of operating said MR valve for said fourth period of time after said demagnetization cycle comprises measuring the strength of the magnetic field in said MR valve.

13. The method according to claim 12, further comprising the step of re-energizing said coil based on said measured strength of the magnetic field in said MR valve.

14. The method according to claim 12, further comprising the steps of:

e. comparing said measured strength of the magnetic field in said valve to a prescribed value, and f. re-energizing said coil when the difference between said measured and prescribed values exceeds a predetermined amount.

15. The method according to claim 1, wherein said coil is energized in step (a) by supplying current from a battery to said coil.

16. The method according to claim 1, wherein said at least one component of said MR valve proximate said passage in which said first remnant magnetization is induced comprises a holder for said coil.

17. The method according to claim 1, wherein said at least one component of said MR valve proximate said passage in which said first remnant magnetization is induced is a first component, and wherein said MR valve further comprises a second component disposed proximate said passage but on a side of said passage that is opposite to said first component, at least a portion of said second component being made from a material having a relative magnetic permeability of at least about 7000.

18. The method according to claim 1, wherein the step of energizing said coil comprises supplying current to said coil from a battery located in said down hole portion of a drill string.

19. In a damping system for damping vibration in a down hole portion of a drill string, said damping system comprising a magnetorheological (MR) valve containing an MR fluid subjected to a magnetic field created by at least one coil, said MR fluid flowing through a passage formed in said MR valve, a method of operating said MR valve comprising the steps of:

a. energizing said coil of said MR valve for a first period of time so as to create a first magnetic field that alters the viscosity of said MR fluid, said first magnetic field being sufficient to induce a first remnant magnetization in at least one component of said MR valve proximate said passage;

b. substantially de-energizing said coil for a second period of time following said first period of time so as to operate said MR valve using said remnant magnetization in said at least one component of said MR valve to create a second magnetic field that alters the viscosity of said MR fluid;

c. measuring the strength of the magnetic field in said MR valve resulting from said remnant magnetization;

d. re-energizing said coil based on said measured the strength of the magnetic field in said MR valve.

20. The method according to claim 19, further comprising the step of:

e. comparing said measured strength of the magnetic field in said valve to a prescribed value, and wherein said step of re-energizing said coil comprises re-energizing said coil when the difference between said measured and prescribed values exceeds a predetermined amount.

21. The method according to claim 19, wherein the step of energizing said coil comprises supplying current to said coil from a battery located in said down hole portion of said drill string.

22. A magnetorheological (MR) valve assembly for damping vibration of a drill bit for drilling into an earthen formation, comprising:

a. a first member capable of being mechanically coupled to said drill bit so that said first member is subjected to vibration from said drill bit;

b. a supply of magnetorheological fluid;

c. a second member, said first member mounted so as to move relative to said second member, said first and second members defining a first chamber and a second chamber for holding said magnetorheological fluid, a passage disposed between said first and second members placing said first and second chambers in fluid communication;

d. at least one coil proximate said passage so that said magnetorheological fluid can be subjected to a magnetic field generated by said at least one coil when said coil is energized;

e. at least a portion of one of said first and second members made from a material having a relative magnetic permeability of at least about 7000 and a coercivity of less than 1.0 Oe;

f. at least a portion of the other of said first and second members being capable of having induced therein a remnant magnetic field in response to said magnetic field generated by said at least one coil that is sufficient to operate said MR valve when said coil is de-energized, said portion of said other of said first and second members in which said remnant magnetic field is induced being made from a material having a maximum remnant magnetization of at least about 12,000 Gauss and a coercivity of at least about 10 Oe and not more than about 20 Oe.

23. The valve assembly according to claim 22, further comprising means for demagnetizing said portion of said other of said first and second members in which said remnant magnetic field is capable of being induced so as to reduce said induced remnant magnetic field.

24. The valve assembly according to claim 23, wherein said means for demagnetizing said portion of said other of said first and second members comprises means for generating a current in said coil that alternates polarity and decreases in amplitude in a stepwise fashion.

25. The valve assembly according to claim 23, further comprising a power supply for supplying a dc current, and wherein said means for demagnetizing said portion of said other of said first and second members comprises circuitry for converting said dc current into a current that alternates polarity and decreases in amplitude in a stepwise fashion.

26. The valve assembly according to claim 23, wherein said means for demagnetizing said other of said first and second members in which said remnant magnetic field is capable of being induced comprises means for reducing said induced remnant magnetic field to essentially zero.

27. The valve assembly according to claim 22, further comprising a sensor for measuring the magnetic field in said MR valve and means for energizing said coil based on said measured value of said magnetic field.

28. The valve assembly according to claim 22, wherein said portion of said other of said first and second members in which said remnant magnetic field is capable of being induced is made from a material having a maximum remnant magnetization of at least about 13,000 Gauss.

29. The valve assembly according to claim 22, wherein said portion of said other of said first and second members in which said remnant magnetic field is capable of being induced comprises a holder for holding said at least one coil.

30. The valve assembly according to claim 29, wherein said one of said first and second members made from a material having a relative magnetic permeability of at least about 7000 and a coercivity of less than 1.0 is a shaft.

31. The valve assembly according to claim 22, further comprising a battery for supplying power to said coil.

32. The valve assembly according to claim 22, further comprising a sensor for measuring the value of said remnant magnetic field.

33. The valve assembly according to claim 32, further comprising means for energizing said coil based on said value of said remnant magnetic field measured by said sensor.

34. The valve assembly according to claim 32, wherein said sensor for measuring the value of said remnant magnetic field comprises a Hall effect sensor.

35. The valve assembly according to claim 33, wherein means for energizing said coil based on said measured value of said remnant magnetic field comprises a microprocessor programmed with software that compares the measured value of said remnant magnetic field to a specified value.

* * * * *

UNITED STATES PATENT AND TRADEMARK OFFICE

CERTIFICATE OF CORRECTION

PATENT NO. : 8,087,476 B2
APPLICATION NO. : 12/398983
DATED : January 3, 2012
INVENTOR(S) : Mark Ellsworth Wassell et al.

It is certified that error appears in the above-identified patent and that said Letters Patent is hereby corrected as shown below:

In the Specification

Column 13, line 7 should read a relative permeability of at least about 7000 -- Gauss --.

Signed and Sealed this
Fourth Day of March, 2014

Michelle K. Lee

Michelle K. Lee
*Deputy Director of the United States Patent and Trademark Office*